US005597043A

United States Patent [19]

Stadulis

[11] Patent Number: 5,597,043

[45] Date of Patent: Jan. 28, 1997

[54] METHOD OF COMPLETING WELLBORES TO CONTROL FRACTURING SCREENOUT CAUSED BY MULTIPLE NEAR-WELLBORE FRACTURES

[75] Inventor: Jerome M. Stadulis, Arlington, Tex.

[73] Assignee: Cross Timbers Oil, Fort Worth, Tex.

[21] Appl. No.: 405,601

[22] Filed: Mar. 17, 1995

[51] Int. Cl.[6] ..... E21B 43/269

[52] U.S. Cl. ..... 166/280; 166/281; 166/297

[58] Field of Search ..... 166/280, 281, 166/297, 308

[56] References Cited

U.S. PATENT DOCUMENTS

| | | | |
|---|---|---|---|
| 3,075,581 | 1/1963 | Kern | 166/280 |
| 3,249,158 | 5/1966 | Kieschnick, Jr. et al. | 166/281 X |
| 3,346,048 | 10/1967 | Strange et al. | 166/281 X |
| 3,664,420 | 5/1972 | Graham et al. | 166/280 |
| 3,850,247 | 11/1974 | Tinsley | 166/280 |
| 4,078,609 | 3/1978 | Pavlich | 166/280 X |
| 4,186,802 | 2/1980 | Perlman | 166/280 X |
| 4,718,490 | 1/1988 | Uhri | 166/281 |
| 5,054,554 | 10/1991 | Pearson | 166/280 |

*Primary Examiner*—George A Suchfield
*Attorney, Agent, or Firm*—Melvin A. Hunn; Felsman, Bradley, Gunter & Dillon

[57] ABSTRACT

In the preferred embodiment of the present invention, completion operations are performed which include a perforation operation followed by a fracturing operation. During the perforation operation perforations (or other means for creating flow paths) are shot at a low perforation density, in order to create a flowpath between the wellbore and the hydrocarbon bearing formation as well as an unknown number of relatively wide fractures and relatively few, but unknown number of fracture initiation sites in the hydrocarbon bearing formation. During the fracturing operations, relatively small, high-concentration proppant slugs with clean spacer stages are pumped early in the treatment, in order to screenout the narrower fractures, but these slugs are not sufficient to screenout the wider fractures. Next, conventional fracturing operations are employed to create and/or enlarge and widen the remaining wider fractures, without the risk of loss of relatively-expensive carrier fluids and proppant material (such as sand) to the now-screened-out smaller fractures. Experimentation has revealed that this technique can be employed to (1) likely create longer and wider fractures, and (2) increase the overall sand-to-fluid ratios.

14 Claims, 14 Drawing Sheets

High-Concentration Schedule

Overall Sand/Fluid = 12 ppg

METHOD OF COMPLETING WELLBORES TO CONTROL FRACTURING SCREENOUT CAUSED BY MULTIPLE NEAR-WELLBORE FRACTURES

BACKGROUND OF THE INVENTION

1. Field of the Invention:

The present invention relates in general to the completion of oil and gas wellbores and in particular to perforation and fracturing operations which are performed during completion operations.

2. Description of the Prior Art:

Those skilled in the art of welibore completions, and particularly fracturing operations, have realized a significant incidence of premature and unexpected screenout of wellbore fractures which cannot be accounted for adequately by various explanations set forth in the prior art literature. When these screenouts are relatively near the wellbore they frustrate further completion operations. These screenouts frustrate the essential goal of fracturing operations which is to enhance production of hydrocarbons from the wellbore by creating relatively wide and long fractures which allow reservoir fluids to drain from the formation into the wellbore for production. These near-wellbore screenouts can have serious negative economic impact on a particular wellbore, and may result in the eventual shutting in of a wellbore which would have been otherwise considered to be a profitable well. A variety of explanations for these near-welibore screenouts are set forth in the literature. None of the explanations accurately explain the occurrence of this phenomena, and certainly none of these publications suggest an industry accepted or adopted prophylactic or remedial operation which can be performed to prevent or reverse the undesirable near-wellbore screenouts.

SUMMARY OF THE INVENTION

It is one objective of the present invention to provide an improved technique for completing and fracturing oil and gas wellbores which provides for a more economical and effective fracturing of hydrocarbon bearing formations by simultaneously minimizing the total amount of relatively-expensive carrier fluids, and increasing the total amount of proppant material, while obtaining an improved fracturing of the hydrocarbon bearing formations.

It is another objective of the present invention to achieve the aforementioned improved fracturing of the hydrocarbon bearing formations by utilizing relatively low-volume, high-concentration proppant slugs during a preliminary controlled screenout fracturing operation to screenout narrow fractures in the hydrocarbon bearing formations, and by following the preliminary controlled screenout fracturing operation by a secondary conventional fracturing operation which is utilized to enlarge a relatively small number of remaining wider fractures.

These and other objectives are achieved as is now described. In the preferred embodiment of the present invention, completion operations are performed which include a perforation operation followed by a fracturing operation. During the perforation operation, big-hole perforations are shot at a low perforation density, in order to create a flowpath between the wellbore and the hydrocarbon bearing formation as well as an unknown number of relatively wide fractures and relatively few, but unknown number of narrow fractures in the hydrocarbon bearing formation. During the fracturing operations, relatively small, high-concentration proppant slugs with clean spacer stages are pumped early in the treatment, in order to screenout the narrower fractures, but these slugs are not sufficient to screenout the wider fractures. Next, conventional fracturing operations are employed to enlarge and widen the remaining wider fractures, without the risk of loss of relatively-expensive carrier fluids and proppant material (such as sand) to the now-screened-out smaller fractures. At present, experimentation has revealed that, this technique can be employed to increase the overall sand-to-fluid ratios (including the pad) from about 2.3 pounds of proppant added per gallon of fluid to over 8 pounds of proppant added per gallon of fluid, on modestly-sized treatments up to 200,000 pounds, but the technique of the present invention is believed to be broadly applicable over a wide range of treatment sizes.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Introduction:

This application discusses possible explanations, based upon previous studies, for the hypothesis that multiple fractures at the borehole wall may be a common feature of the hydraulic fracturing process. It then uses field examples to show that a type of low-concentration screenout common to three fields in Texas and Oklahoma was caused by multiple fractures. Next, it shows how a completion was developed that controls loss of the pad and slurry to multiple fractures. Finally, it discusses some of the implications for completion design in general. Since the symptoms of the low-concentration screenout have been documented in the literature by other authors and appear to be quite common, the design techniques of the present invention should be effective in other areas as well.

The completion design combines unoriented, zero-degree-phased, bighole perforations shot at low density; and small, high-concentration proppant slugs with clean spacer stages pumped very early in the treatment. These strategies were chosen (1) to limit the number of separate fractures that initiate from individual perforations, and (2) to screenout narrow fractures early in the treatment so that more width is developed in the remaining fracture(s). These techniques have been used to increase overall sand/fluid ratios (including the pad) from about 2.3 ppg (lb added per gal fluid) to over 8 ppg, on modestly-sized treatments up to 200,000 lb.

In all the areas covered by this study it had been difficult to complete stimulations when we tried to reduce pad fractions below 40% and/or increase sand concentrations past 6 ppg. The proppant-induced pressure increase that leads to a near-wellbore screenout (Barree[1]) was a common factor in all these attempts. These screenouts occurred even when we had designed the pump schedules on modern, three-dimensional (3D) fracture design simulators, using reliable input data.

Even the most up-to-date simulators are notoriously unreliable design tools unless they are adjusted for the peculiar leakoff conditions of each well, either by a calibration treatment, or by a generous infusion of local knowledge. Uncalibrated simulations routinely predict ample width for slurry concentrations up to the operational limits of pumping equipment, but experienced engineers know that most treatments screenout at much lower concentrations. Unless fluid loss is increased by the modeler, or the screenout criterion is set very conservatively, design models do not predict fracture treatments should screenout at the low concentrations that they commonly do.

Figure 1:
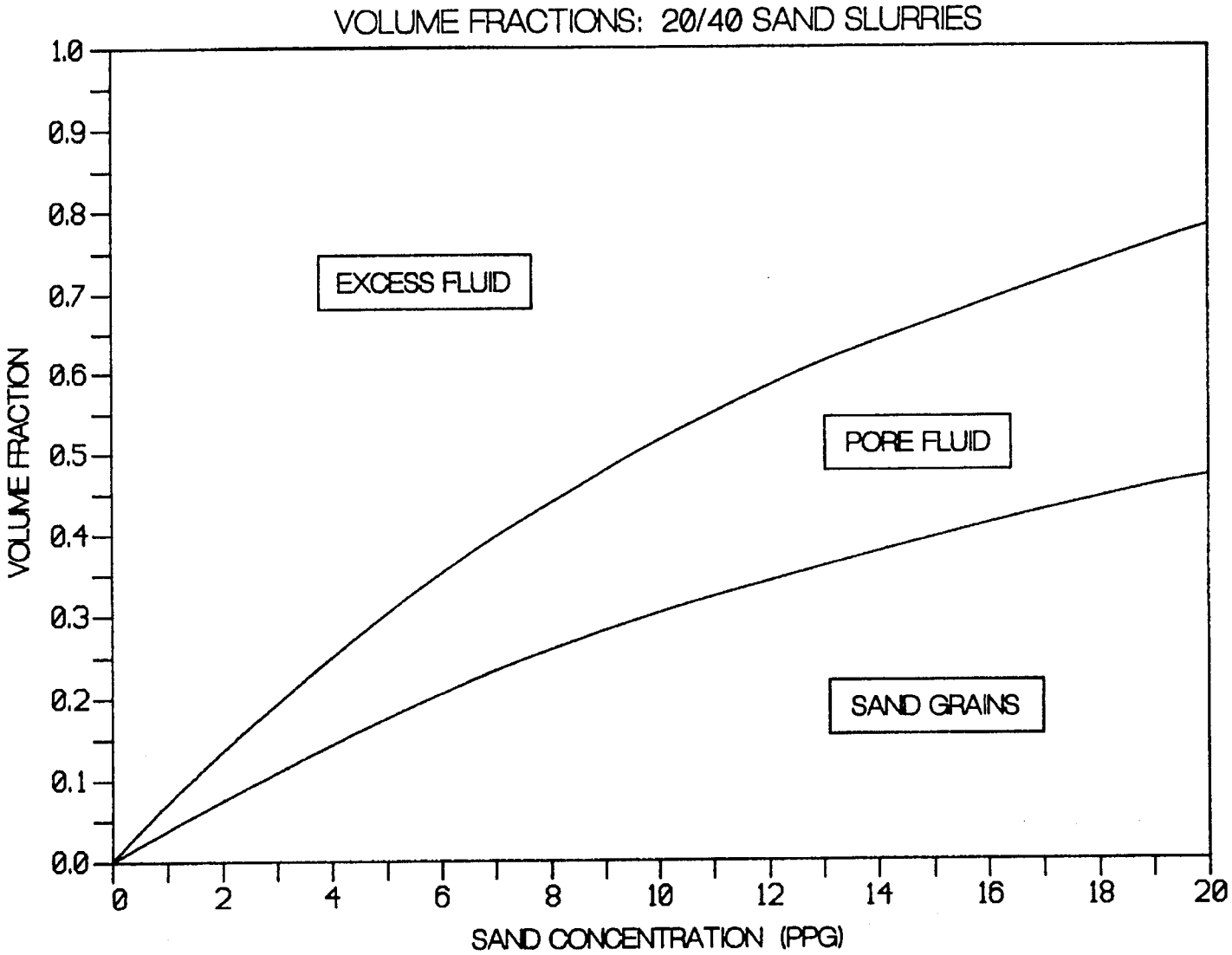
FIG. 1 is a graphical representation of sand concentration versus volume fraction for sand slurries.

These results are puzzling when one considers just how little sand is contained in slurries that frequently cause screenouts. For example, FIG. 1 shows that a 6 ppg slurry contains only about 35% sand on a bulk volume basis and 18 ppg still has 25% excess fluid.

Various authors have postulated that the causes of low-concentration screenouts are an immobile proppant bank that forms near the well[1], restricted width within a tortuous connection between the well and a single fracture (i.e. tortuosity)[2], or reduced fracture width caused by multiple fracture strands[2–5] that either originate at the wellbore, or develop at a significant distance into the formation[6].

Multipie Fractures in the Literature:

The possibility that multiple fracture strands might be a common feature of the fracturing process has not been widely discussed nor accepted in the industry. This is because a large number of strands is necessary to explain the level of abnormally high net pressures observed during fracturing[7], or because their presence is thought to require unusual combinations of reservoir conditions such as overpressuring and micro-cracks aligned in the preferred direction of fracturing[8]. Another possible reason that multiple fractures are not widely considered is because they complicate a well-established design and analysis process that is based upon a much simpler conceptual model—a single planar fracture with symmetrical wings that acts independently of the borehole wall.

However, Jeffrey et al[9] reported an example from a numerical model study and showed that a second fracture has an opening pressure only about 7% greater than that of a single fracture. This result is important, because it implies the borehole wall has only a slight ability to resist the formation of secondary fractures. Very early in a treatment, Jeffrey et al's criterion may be somewhat of an upper bound, because fractures should find it easier to initiate from defects at the borehole wall (e.g. perforations).

Behrmann and Elbel[10] reported a series of laboratory experiments they performed on actual sandstone samples under stress similar to in-situ conditions. They showed that individual fractures often initiate from individual perforations and also from the annulus that is forced open at the cement/rock interface. Behrmann and Elbel demonstrated that the borehole wall and any fractures that originate from it interact as a coupled system. However, in their experiments all the secondary fractures stopped within one wellbore diameter and only a single primary fracture propagated beyond the near-well area.

Warpinski et al[11] presented a remarkable study in which they documented the recovery of 38 fracture strands from a deviated core of the Mesaverde Sandstone in the Piceance Basin. The fractures had originated from two mini-fracs and a fracture stimulation of an offset well at the U.S. DOE's Multiwell Experimental (MWX) site that had been perforated with 96 holes at a density of 2 SPF. Half the strands might have contained conductive proppant that was washed away during the coring process. However, the remaining strands, at a distance of only 60 to 70 ft from the fractured well, had very little conductivity because they were very narrow and were obstructed by abundant gel residue.

At first glance, Warpinski et al's documentation of far-field multiple fractures seems to conflict with the laboratory observation that secondary fractures do not propagate far from the wellbore. However, the laboratory observation was an artifact of the sample size (only 2.5 wellbore diameters from wellbore to edge of sample) and the fact that the samples were exposed to pore pressure at their sides. In this situation, once a primary fracture reaches the edge of a sample, all the pressure inside the fracture is exhausted, so other fractures that have slightly higher pressure thresholds cannot be extended.

Possible Reasons for Multiple Fracture Strands:

At in-situ conditions, a single fracture will extend radially until it encounters a lateral or vertical growth restriction. If the restriction causes the pressure to rise above the next opening pressure threshold at the borehole wall, the next strand should open and start to propagate. Furthermore, unless pre-existing cracks help them connect, individual fractures tend to grow separately and not join together. This happens because the pressure holding the fracture open compresses the rock near the fracture faces and consequently increases the stress near them. This locallyhigher stress repels any approaching fractures.

Ironically, those situations we think of as being most conducive to generating long fractures, i.e. thin zones well-bounded by much-higher-stress intervals, may be naturally predisposed to the shortest fractures. When the high-stress beds are close, the first fracture should reach them very quickly. The influence of the bounding beds should then cause the wellbore pressure to quickly reach the successive thresholds at which additional strands open.

This is similar to the concept of formation pressure capacity discussed by Nolte and Smith[12], where certain pressures define the thresholds which cannot be exceeded within a single fracture without effectively arresting its lateral growth (e.g. when the pressure gets high enough to open fissures off the faces of the fracture). The difference is that the limitation noted in the previous paragraph may be more severe because it applies to the fracture and the wellbore as a coupled system.

If this hypothesis is correct, each particular combination of stress, thickness, modulus and wellbore diameter may produce its own practical limit to how far fractures can penetrate for small injection volumes. Even if we presume ideally that only one fracture initiates at the beginning of any fracturing operation, two generic types of fracturing should ultimately develop. The first is the well-recognized case: a fracture that is unrestricted vertically and laterally should have radial geometry. The second is much more complex but may in fact be more common. A "weak" borehole wall coupled to a well-bounded pay zone may make it impossible to achieve elongated fractures without first generating and propagating multiple narrow fracture strands. This may be part of the reason why observed fracturing pressures are often significantly higher than they should be based on theoretical predictions[7].

For heterogeneous rock under in-situ conditions, the growth of multiple fractures is likely to be a complicated dynamic process, with one strand growing until pressure rises enough to encourage another. Individual strands should trade places with each other as first one strand, and then another, becomes the leader in a race to extend.

Current fracture design models are well-equipped to compensate for excessive fluid loss from multiple fractures by lumping that effect into features such as the fluid loss coefficient or the opening of far-field fissures. The primary result of that approach will be to ensure that jobs are pumped to completion without screening out. However, when multiple fractures that originate at the borehole wall are the mode of fracturing, it is doubtful that penetration or conductivity, and therefore productivity, will be increased at all in proportion to the amount of extra sand placed. In addition, it will be much more difficult to develop rational design strategies if the basic presumptions about geometry are only partly correct. This means that recognition of multi-stranded fracturing behavior is not merely an academic issue, but an important practical one as well.

In fact, there are significant risks to the well if this behavior is not properly recognized. It is possible to reduce productivity by forcing fluid, sand, and concentrated polymer under high pressure into a limited volume of reservoir rock when a treatment is screening out near the wellbore. This may explain the abnormally high treating pressures, the elevated residual stress, and the poor production performance reported by Medlin and Fitch[6] for some massively fractured Mesaverde Sandstone wells in the Piceance Basin. We have observed the very same symptoms in a Permian Basin dolomite reservoir after we continued pumping slurry during a treatment that appeared to be screening out near the wellbore.

Even though the study by Jeffrey et al suggests that the borehole wall may initially be "weak", it seems reasonable to expect that it should become increasingly resistant as competition among fractures for opening space increases the compressive stress near the borehole wall. It also appears that it is possible to take advantage of this effect with appropriate design techniques, and control the excessive loss of pad and slurry to multiple fractures that would otherwise limit fracture penetration. That is the underlying theme of the present invention.

To summarize, there is a significant amount of evidence that suggests (1) multiple fracture strands initiate from individual perforations and from the borehole wall, (2) multiple fractures are a common feature of the fracturing process, and (3) the reduced width in each is a significant cause of nearwellbore screenouts at low sand concentrations. This evidence includes, but is not limited to the studies referenced above, frequent observations that transient tests find much shorter and less-conductive fractures than design models predict, and the data that will be presented in the Field Examples section of this specification which follows below.

Finding a way to control multi-stranded fracturing behavior is clearly a matter of practical importance in low-permeability reservoirs. An effective design should allow the placement of a fracture that has higher conductivity and is less obstructed by polymer residue, and should generate longer propped fractures for those cases where insufficient width in numerous strands would have caused proppant bridging and screenouts near the well. It should also reduce the likelihood of saturating and damaging the area near the well, where these conditions can have their greatest detrimental effect. If a design can meet any of these objectives, it should tend to improve production from a fractured well. At a minimum, an effective design will place the same amount of proppant with less carrying fluid, and therefore should make fracturing more economical.

Figure 11:
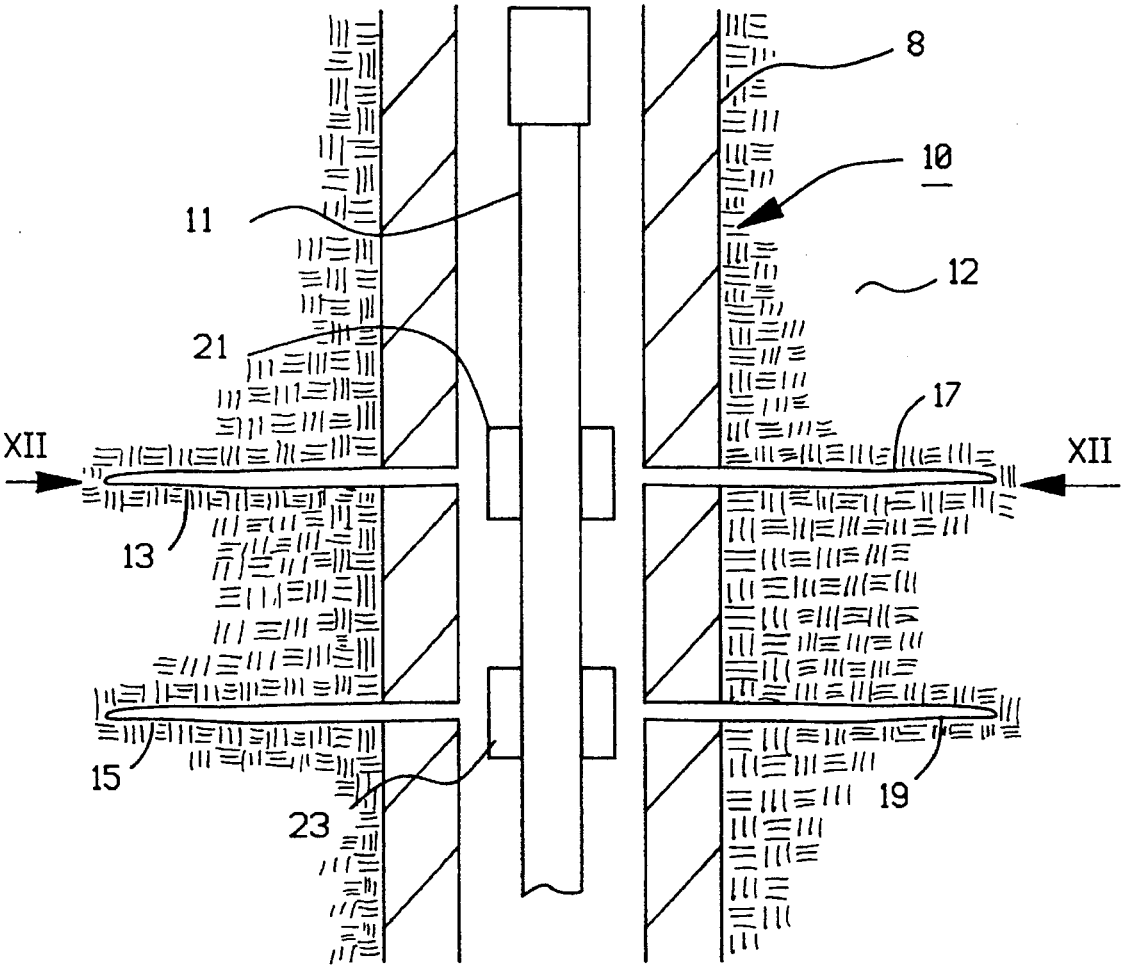
FIG. 11 is a simplified depiction of a wellbore during perforation operations.
Figure 12:
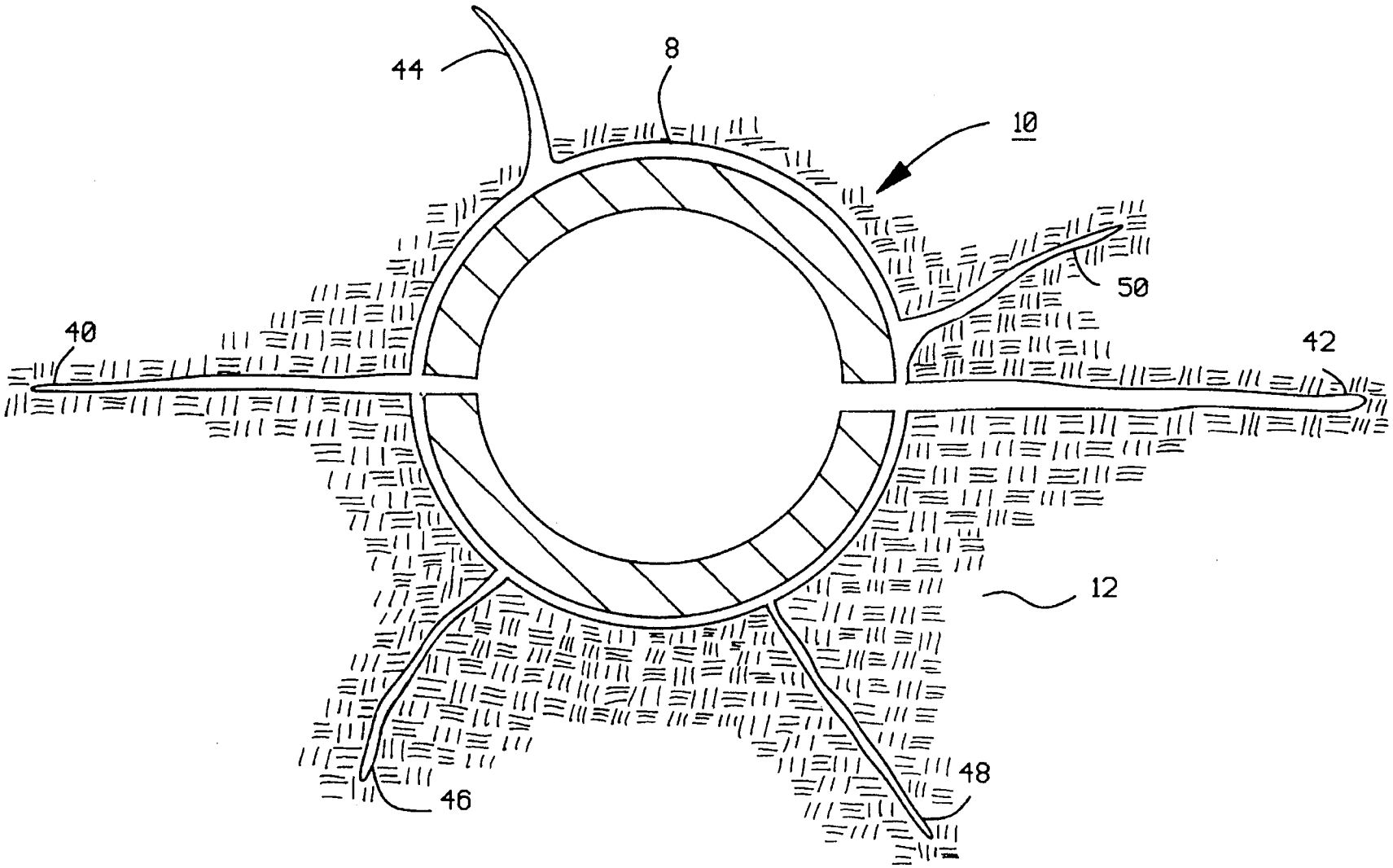
FIG. 12 is a cross-section view of the wellbore of FIG. 11.

FIG. 11 is a simplified longitudinal section-view of wellbore 10 which extends from the earth's surface downward into formation 12, and which is cased by casing string 8. A tubing conveyed perforating gun 11 is lowered within casing 8 to locate perforation guns 21, 23 in desired locations. While FIG. 11 depicts a tubing conveyed perforated system, a more conventional wireline-conveyed perforating apparatus could alternately be utilized, and the depiction of a tubing-convey perforating system is thus merely exemplary and not intended to be limiting of the present invention. Perforating guns 21, 23 are spaced apart a preselected distance within the tubing string, and include a predetermined number of perforation charges which are adapted to provide a particular size (diameter) perforation. Additionally, the perforation charges are oriented or unoriented in a particular phase configuration. FIG. 12 is a cross-section view of FIG. 11 as seen along section line XII—XII. As is shown, tubing conveyed perforating gun 11 is centrally disposed within casing 8 of wellbore 10. A plurality of perforations are formed in formation 12 by the perforating guns. When the fracturing operation is started by commencing fluid injection, many (if not all) of the perforations initiate separate fractures such as 40 and 42. As these fractures grow, the interface between the casing 8 and the borehole 10 is forced apart. Continued fluid injection may cause additional fractures such as 44, 46, 48, and 50 to initiate from the borehole 10 irrespective of the location of the perforations. In practice, it is difficult or impossible to determine the number of such additional fractures which are formed within the formation 12. As the operation continues, these multiple fractures cause a large portion of the injected fluid to leak off and be lost into the formation 12, which severely reduces the width and length in the fractures. In the prior art, a large amount of additional fluid must be pumped during the operation to compensate for this leak off. Further, the fact that many fractures are open severely limits their penetration into the formation 12, and frustrates the essential goal of the fracturing operation, which is to create relatively wide and especially long fractures. In accordance with the present invention, a preliminary controlled screenout operation is performed upon wellbore 10 by directing a plurality of relatively low-volume, high-concentration proppant slugs into the formation to screenout the narrow fractures 44, 46, 48, and 50. In accordance with the teachings of the present invention, screening out the narrower fractures prevents the loss of carrier fluid to formation 12 through the narrow fractures, and thus allows conventional fracturing operations to create and/or enlarge a relatively small number of remaining wider fractures, such as fractures 40, 42.

Figure 13:
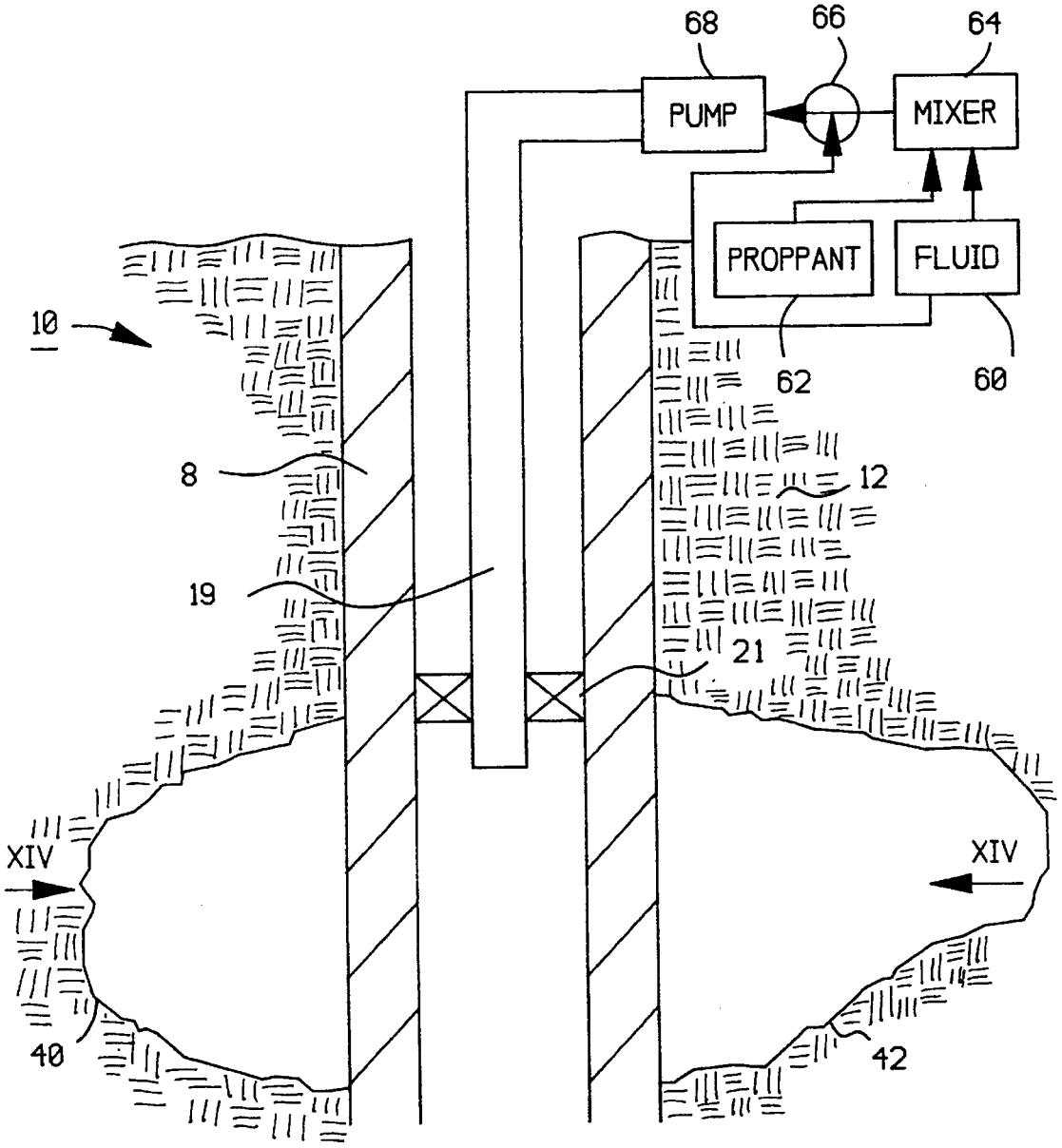
FIG. 13 is a longitudinal section view of a wellbore during fracturing operations.

The cased wellbore 10 and surface equipment utilized during fracturing operations are depicted in schematic form in FIG. 13. As is shown, a completion string 19 is located within cased wellbore 10 and packers, including packer 21, are set to isolate annular regions defined between casing 8 and completion string 19. While a through tubing completion is depicted and described, an alternative casing completion could alternatively be utilized, and the depiction of a through tubing completion is thus merely exemplary and not intended to be limiting of the present invention. A pump 68 is located at the surface of cased wellbore 10, and is utilized to deliver through completion string 19 a fracturing treatment in accordance with a treatment schedule. In accordance with the present invention, a preliminary controlled screenout fracturing operation is conducted by delivering a plurality of relatively low-volume, high-concentration proppant slugs into formation 12 to screenout narrow fractures 44, 46, 48, and 50 (of FIGS. 12 and 14). A mixer 64 is utilized to mix proppant 62 and fluid 60 in accordance with the fracturing schedule. A switching arrangement 66 is provided to allow for the delivery of clean spacer stages between the low-volume, high-concentration proppant slugs. The preliminary controlled screenout fracturing operation is followed by a secondary conventional fracturing operation which directs fracturing fluids, including proppant material, to wider fractures 40, 42 to elongate and widen such fractures and allow for the depositing of proppant materials.

Figure 14:
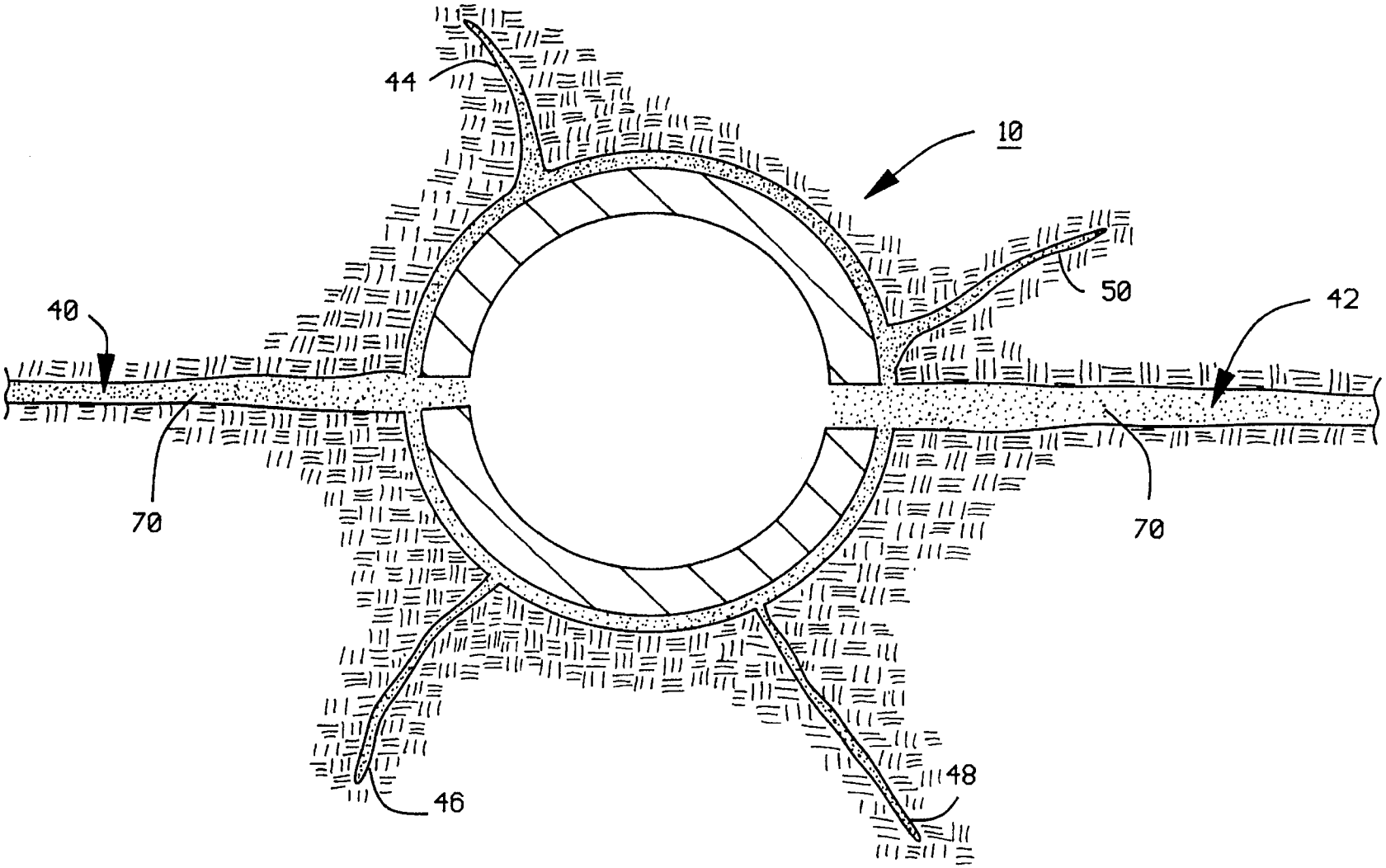
FIG. 14 is a cross-section view of the wellbore of FIG. 13.

FIG. 14 is a cross-section view as seen along section line XIV—XIV. As is shown, narrow fractures 44, 46, 48, and 50 have been filled with proppant material, and have been intentionally screened out to prevent their enlargement and elongation. This allows the fracturing fluids to act on the wider fractures 40, 42 to elongate and widen them, and to deposit proppant material 70 therein.

Comparison With Prior Art Completion Designs:

In the areas covered by this study, "standard" completions are mostly perforated 4 SPF ("Shots Per Foot"), 90° phased, with deep-penetrating charges that give approximately 0.4 in. entrance holes. The perfs are broken down and the zone is fractured with crosslinked fluid using a 40% pad and a 1 ppg to 6 ppg ramp. Sometimes the fluid is foamed and sometimes the 6 ppg stage is extended slightly to place additional sand. Most of these treatments place 50,000 to 75,000 lbm 20/40 mesh sand at an overall sand/fluid ratio of 2.0 to 2.5 ppg (pounds per gallon).

The 4 SPF perforation density in these wells is somewhat of an industry standard and most wells have between 40 and 160 perforations. In contrast, in the present invention, the new completion was designed to limit the number and complexity of fracture initiations by limiting the number of perforations and the directions in which they are shot. We perforate no more than 1 SPF, zero-degree-phased but unoriented, and use big-hole (0.5 to 0.6 in.) charges to reduce perforation friction. These are not limited-entry completions in the classic sense where a few holes are placed over an extensive gross interval to try to ensure multiple zones are treated; most of the pay zones in the study were compact, and seldom exceeded 20 ft in gross thickness perforated.

In the present invention, we also employ small, high-concentration proppant slugs very early in the treatments to screenout or divert from fracture strands that might remain, but have insufficient width to accept the concentration of the slugs. This is conceptually and operationally different from another technique[2], which attempts to hold open a pathway through a tortuous restriction by placing a slug and allowing the fracture to close on it before additional fluid is pumped. We currently pump slugs continuously without shutting down until all of them have been placed into the zone.

We typically use a relatively light gel loading of 25 ppmg (lbm per 1,000 gal) and start these treatments with approximately 12 bbl of pre-pad, followed with four 10 bbl slugs, each with 2000 to 3000 lb 20/40 mesh sand mixed at 5 to 12 ppg. We place 10 bbl clean spacer stages between the slugs to reduce the likelihood of an early screenout, then slightly overdisplace all the slugs through the perforations. The displacement fluid becomes part of the pad for the main treatment. We have experimented with the size of the pre-pad, the slugs, and the spacer volumes. Our objective was to achieve a balance between slugs that were large enough to be effective, yet not large enough to unduly risk a premature screenout. Secondary objectives were to minimize fluid volume and therefore the job cost, and avoid saturating the area near the well.

After we displace the slugs, we shut down for 5 to 10 minutes to compare the character of the pressure fall-off to predictions from a fracture design model[13]. This step takes the place of a rigorous mini-frac analysis and is very helpful because the character of the fall-off appears to qualitatively indicate the degree of fracture complexity near the wellbore. (More fracturing in the pay zone will expose a greater portion of the injected volume to permeable rock and leakoff will be more severe, therefore pressure fall-off will be quicker than for ideal geometry.) It also provides a baseline for comparison that can be used to diagnose an impending near-wellbore screenout later in the job.

It is important to emphasize that we don't wait long enough to allow the fracture to close on the slugs. It is our intention, at this point in the treatment, to have reduced the number of secondary fracture strands, and to have something more proximate to a wide primary fracture, which will be open and ready to accept high slurry concentrations.

Operational Results Of the New Design:

These changes appear to reduce the number of fractures that initiate and extend from the perforations and the borehole wall. This develops more width in the remaining fracture(s) and reduces the incidence of near-wellbore screenouts. We have been able to reduce pad fractions to around 20% and have routinely pumped main treatments that start at 9 and reach 12 or 13 ppg. Recent jobs have placed as much as 200,000 lbm 20/40 mesh sand with only 25,000 gallons of crosslinked fluid in zone, which is an overall sand/fluid ratio of 8 ppg. This is 3.5 times the overall concentration of previous (prior art) designs, and all the slurry in the main part of the job exceeds the concentration that previously would have guaranteed a screenout.

These techniques have allowed us to pump much more proppant without increasing our stimulation costs. It seems logical that they should also produce a longer, a cleaner, and therefore a more effective propped fracture (or fractures), but this hypothesis needs to be confirmed by pressure transient tests.

Background:

This project started because we encountered a specific workover and completion problem with Red Fork Sandstone gas wells in the Anadarko Basin of northwest Oklahoma around 1989.

Red Fork Sandstone Description:

In this specific area, which is centered in Major County, the Red Fork Sandstone has a variety of different facies. These sandstones were deposited in fluvial channel, distributary channel, and streammouth bar sedimentary environments. Permeability varies from at least 9 md to less than 0.1 md, with the best reservoir being the fluvial channel deposits, and the poorest being the stream-mouth bars. Net pay thickness varies from about 40 ft to 5 ft. Original reservoir pressure, at a normal fresh-water gradient, is between 2500 and 3200 psi depending on depth. Reservoir temperature is approximately 165° F. This area was originally developed in the 1950s, and has been infill-drilled since the mid-1970s.

Most of the best producers are older wells that were completed in reservoirs that appear to have permeability significantly better than 0.25 md. However, there are a significant number of wells where permeability is likely to be in the range of 0.1 to 0.25 md. In this last category, it has been difficult to make economic single-zone completions from the Red Fork in normally-pressured areas, even when hydraulic fracturing has been used. This is particularly true of the stream-mouth bars, where net pay rarely exceeds 15 ft.

These bars are encased in non-reservoir siltstones and shales, where the thickness ratio of impermeable rock to reservoir is usually at least 10:1. The bars are continuous on a scale much larger than the penetration desired for typical fracture stimulations, so there should be no significant restrictions to lateral growth. Frac gradients are normal and there is no evidence of unusual downhole stress caused by faulting or other tectonic activity.

Typical Stimulation and Fracture Design Problems:

The original problem we encountered was that a number of older, lower-pressured wells that we attempted to fracture stimulate were actually hurt by the treatments and required extensive clean-up periods before they returned to their original rates. These were wells that had either never been fracture-stimulated, or had been stimulated with sand volumes and concentrations much smaller than those being pumped during modern completions. Reservoir pressure had been reduced from an original value of about 2500 psi to a range of 500 to 1100 psi around these wells. In addition, we noticed that some of our new completions in normally-pressured zones appeared to be damaged after they were killed during routine operations.

During the same time period, we also performed a series of pressure build-up tests on Red Fork wells that had been fracture stimulated. We were surprised to find that most of them had no substantial evidence of fracture-dominated flow on the log-log diagnostic plots, and a few actually had positive skin. Some of these were new wells that appeared to have been successfully stimulated because they had been low-rate producers after acid breakdowns, but were economic completions similar to their offsets after being fracture stimulated.

Based on the transient tests, we concluded we should be able to substantially improve well performance if we could improve fracture half-length and/or conductivity. To accomplish this, we purchased a numerical fracture simulation model[14] and ran numerous long-spaced sonic/mechanical properties/stress logs so we would have reasonable input data for the fracture design model.

As we used the model to design fracture stimulations, we found it always predicted we could pump treatments with much less pad and with much higher sand concentrations than were typically used in this area. In spite of all the empirical evidence that suggested it was not possible to pump small-pad, high-concentration treatments, we attempted a few. All of them screened out when downhole proppant concentration reached 6 to 8 ppg.

At approximately the same time, we encountered similar problems in a Canyon Sandstone oil reservoir on the eastern shelf of the Permian Basin, in Coke Co., Tex. The industry-standard design for this zone is essentially identical to that for the Red Fork, and is very conservative because of the risk of screenouts.

We were fortunate in the Canyon Sand field to be able to use a static, open annulus (dead string) while pumping down tubing during many of our fracture stimulations. The accurate bottomhole pressure data we gathered this way were instrumental to diagnosing the likely causes of the proppant-induced pressure increase and near-wellbore screenouts.

Examples of Ideal-Geometry Fracturing:

Results from a 3D fracture design model[13] are shown below for two very different pump schedules for the same example well. They should be used as a reference for the subsequent field examples, because they demonstrate the expected differences and similarities in treating pressures if the fracture geometry is ideal, i.e there is a single, vertical, planar fracture. Treating records for all these examples, except one referenced from another paper, show bottomhole treating pressure (BHTP) instead of net pressure. This was done because we did not often have reliable measurements of closure pressure from which to calculate net pressure, and because many of those skilled in the art will have a better intuitive feel for treating pressure. Common pressure and time scales have been used as much as possible to make it easier to see the similarities between the wells.

Figure 2:
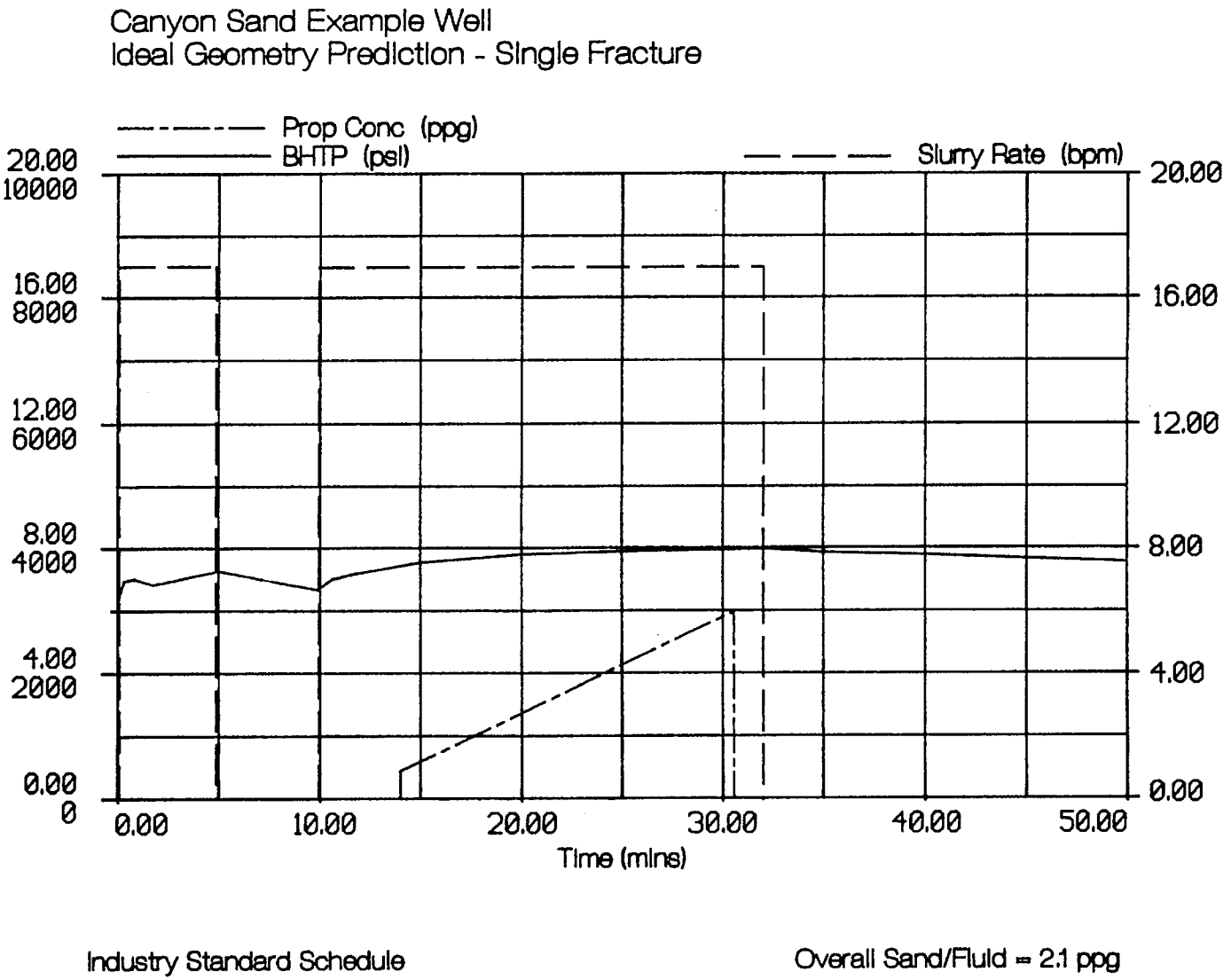
FIG. 2 is a simulation of an industry standard, prior art fracturing schedule for a Canyon Sandstone oil well.

FIG. 2 is a simulation of an industry-standard schedule for a Canyon Sandstone oil well where formation and frac fluid properties are very similar to Canyon Sand Well 13, which is one of the wells discussed later as a field example. This design places 35,000 lb sand with 16,700 gal crosslinked fluid and uses a 40% pad. Maximum sand concentration is 6 ppg and overall sand/fluid ratio is 2.1 ppg.

Note the very gradual increase of BHTP during injection that indicates extension against moderate restrictions. This simulation also has a short (5 min) shutdown during the pad to demonstrate how the character of the pressure fall-off should ideally change as the treatment progresses. Note that the final pressure fall-off is noticeably slower than the early one. This should happen when height growth into impermeable zones isolates more of the fluid from the permeable reservoir.

Figure 3:
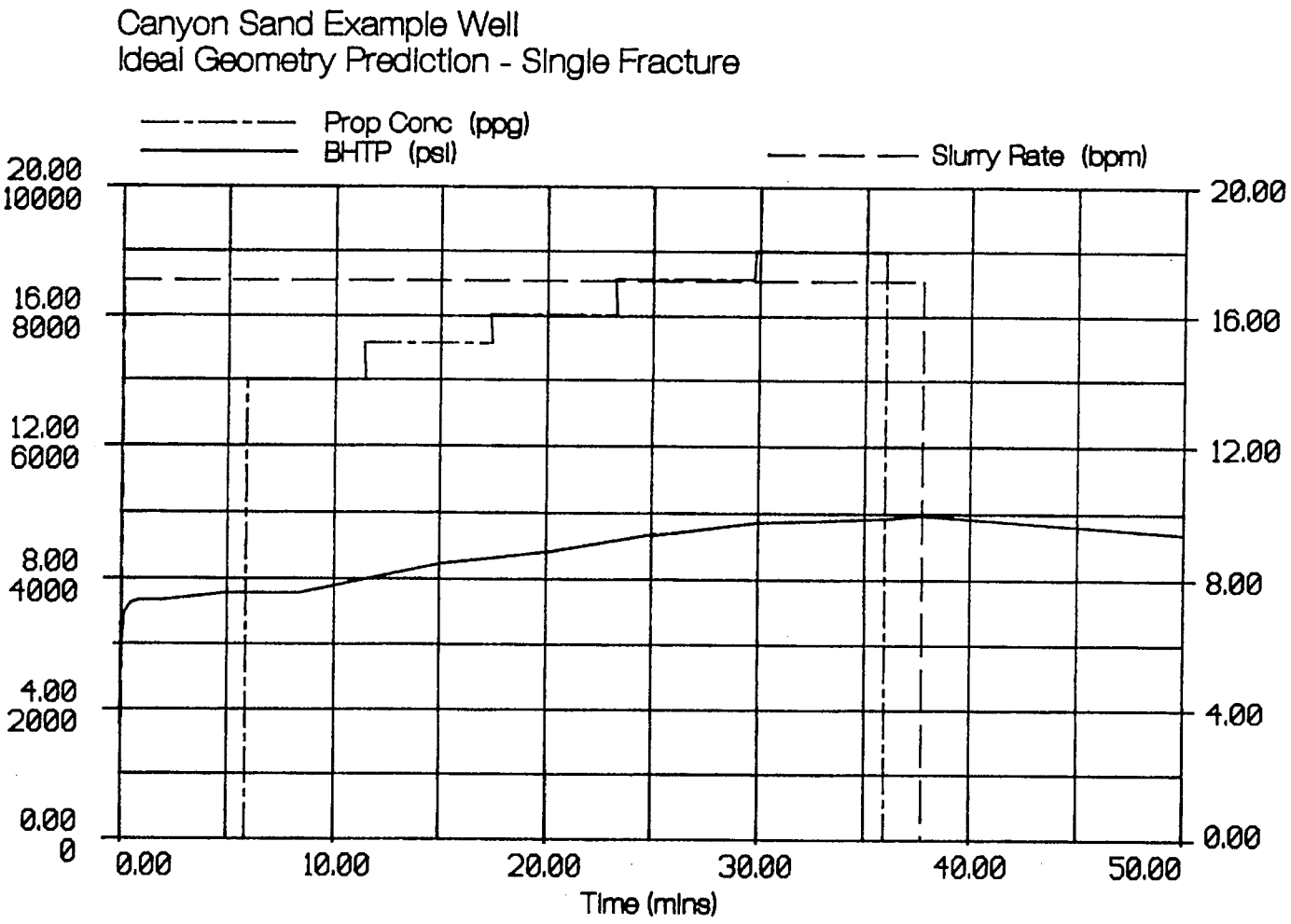
FIG. 3 is a simulation of a very high concentration fracturing schedule for a Canyon Sandstone oil well, which is theoretically considered to be possible, but which practically considered to be impossible, thus revealing deficiencies in fracturing models.

FIG. 3 is a simulation for the same example well as FIG. 2, using the same volume of clean fluid, but with a very-high-concentration slurry schedule. This treatment places 200,000 lb sand at 14 to 18 ppg, and overall sand/fluid ratio is 12 ppg, nearly 6 times the standard design. In this case the treating pressure is forced to a higher level (nearly 1.0 psi/if) to accommodate the larger volume of concentrated slurry, but the pressure changes both preceding and following the final shutdown are gradual. This is because there is no proppant bridging near the well and because there is good leakoff control, just like the low-concentration design. In those cases where geometry is nearly ideal it may not be possible to reach a final treating pressure as high as this example because of the limitations to formation pressure capacity that Nolte and Smith[12] have defined. Nonetheless, the basic point about the character of the pressure fall-off still applies: even when designs approach genuine tip screenout conditions, the pressure fall-off should be very gradual for an efficient fluid.

Field Examples:

The field examples that follow show the typical problems we encountered, the diagnostic work that resolved them, and the development of our current completion design of the present invention.

Figure 4:
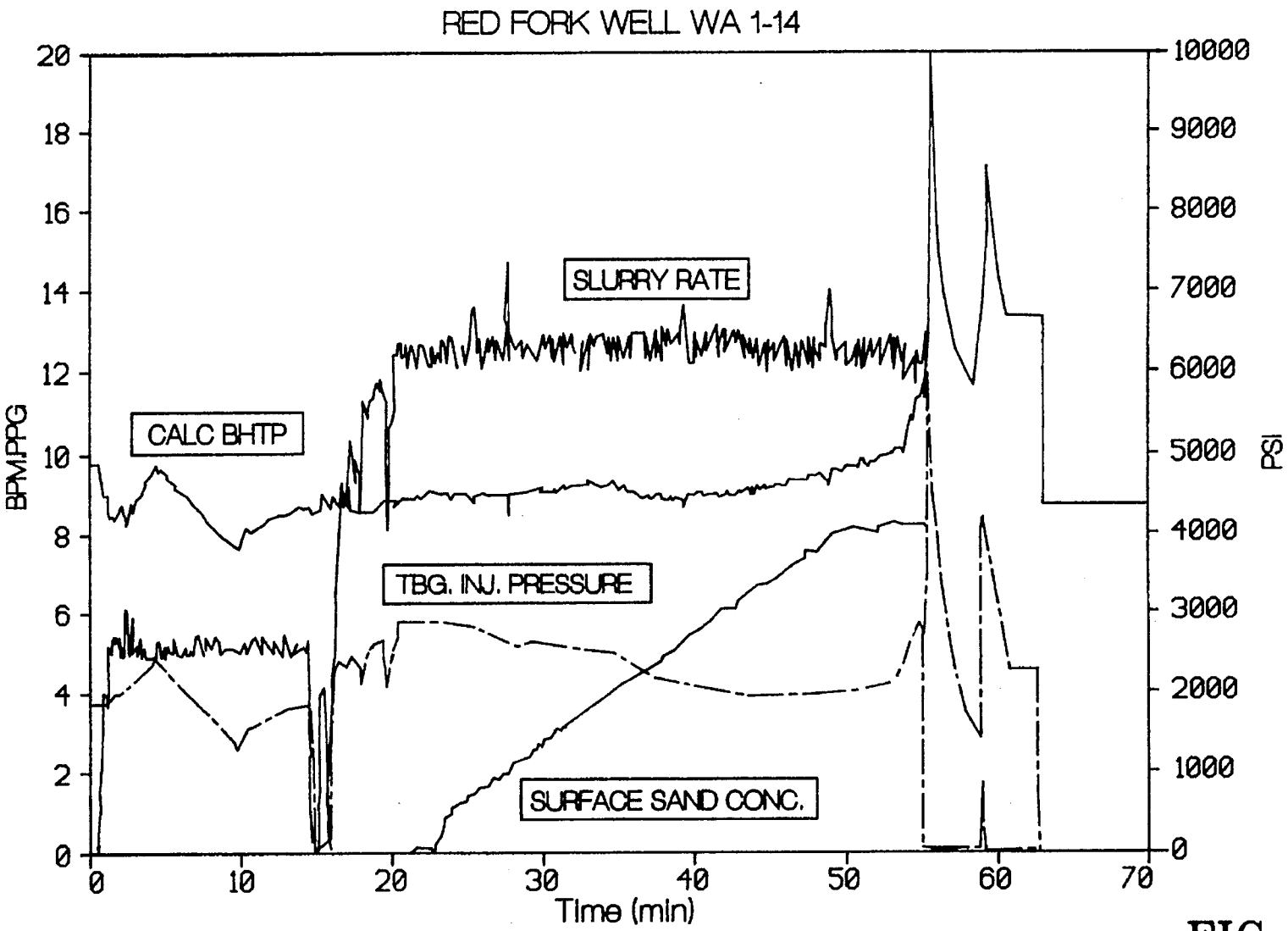
FIG. 4 is a treatment record for a well which experienced a near-wellbore screenout.

Typical Examples of Near-Wellbore Screenouts:

FIG. 4 is the record from one of the Red Fork treatments where we attempted to reduce the pad, and tried to pump 8 ppg slurry at the end of the job. This well, noted as Red Fork Well WA 1–14, has an 8 ft thick pay zone that was perforated with 32 holes at 4 SPF, 90° phased, in a stream-mouth bar at about 7,000 ft. The perfs were balled off before the frac job, and the treatment was pumped down 2⅞ in. tubing using a time-delayed borate-crosslinked fluid. A packer isolated the annulus, so the BHTP shown was calculated from the surface pressure and is therefore reliable only during shutdowns. During the main part of the job, when the injection rate was about 12.5 BPM, wellbore transit time was about 3.5 minutes.

Early in the job, we shut down to measure the true BHTP. As we continued the treatment, tubing injection pressure showed a trend that is characteristic of many small jobs that screenout at 6 to 8 ppg. As sand concentration is increased after the pad, wellhead treating pressure (WHTP) decreases because the average fluid density in the tubing increases. When prop concentration reaches 3 to 5 ppg at the perfs, WHTP stabilizes. WHTP is relatively constant until rapidly increasing BHTP finally overwhelms the extra hydrostatic pressure of the increasingly dense slurry. The screenout occurs abruptly, soon after WHTP starts increasing. This job was designed for 101,000 lbm, but screened out with only 56,000 lb in zone. Overall sand/fluid ratio was 2.9 ppg.

We are aware of only one simulator[15] that incorporates a feature (the formation of an immobile proppant bank between the well and a single fracture) that predicts these quick pressure increases. Barree[1] used it to conclude that many screenouts occur very close to the wellbore because that was the only way to explain the quickness of the pressure increase. My experience, which is mostly with moderate-size treatments of under 200,000 lb, is consistent with Barree's conclusion. I would estimate that at least 95% of the screenouts I have observed were close to the wellbore based on this criterion.

In addition to the quickness of the pressure rise, the characteristic quickness of the fall-off is extremely difficult to reproduce with fracture models. Cipolla et al[16] found that about 50% of treatments they analyzed from the Frontier formation on the Moxa Arch in southwestern Wyoming had excessively high treating pressure they attributed to "proppant effect." BHTP increased above model-predicted values soon after proppant entered the formation and the excessive pressure declined rapidly after shut-down. The authors noted that some of these "pressure-outs" appeared to be wellbore or perf screenouts.

The Moxa Arch Frontier examples are very similar to most of those instances where we have observed screenouts, except the Frontier treatment rates and volumes were considerably larger. Maximum slurry concentrations were not much greater than 8 ppg, and overall sand/fluid ratios, including the pad, were approximately 3 ppg. Compared to our schedules, these were essentially scaled-up jobs with slightly more aggressive sand schedules.

Figure 5:
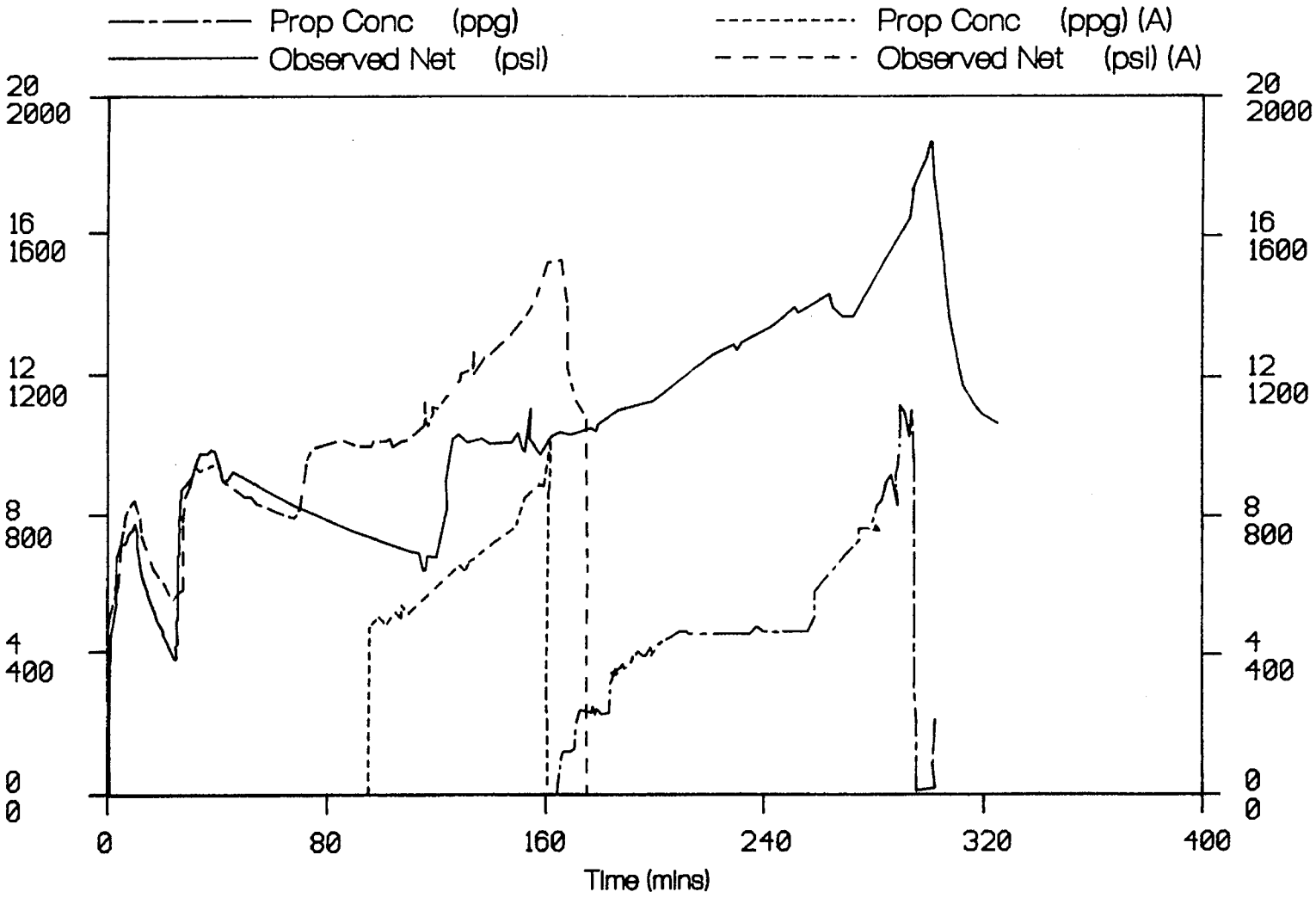
FIG. 5 is a graphical depiction of the proppant effect from two treatments, which are superimposed on the same graph.

FIG. 5 shows examples of the "proppant effect" from two treatments, superimposed on the same graph. Although the pressure changes are accentuated because they are shown as net pressures, the similarities to the typical Red Fork screenout are striking. The pressure breaks were interpreted by the authors as barrier breakthroughs, but could also have been caused by the opening and partial extension of additional near-wellbore fracture strands in a very-low-permeability reservoir. It is noteworthy that the median permeability the authors reported for the Frontier, 0.01 md, is significantly lower than the Red Fork, and overall permeability-thickness is approximately 20% of the average Red Fork zone. The Frontier should have an even greater resistance to fluid loss, yet it also appears to be difficult to frac with high concentrations.

The next treating record is from a well in a Canyon Sandstone oil field on the Eastern Shelf of the Permian Basin in Coke County, Tex. Canyon permeability here is approximately 2.5 md, or about 10 times that of the Red Fork. The reservoir is the remains of a series of turbidite flows (submarine fans and filled-in channels) so there are numerous permeable stringers separated by shales. The gross interval is found at a depth of about 5100 ft and is often 50 to 60 ft thick. It is encased by shale above and below, and impermeable-to-pay-zone thickness ratio is about 8:1. Like the Red Fork, the pay is normally-pressured, except where it is affected by depletion, and stress is normal. Reservoir temperature is about 135° F.

Figure 6:
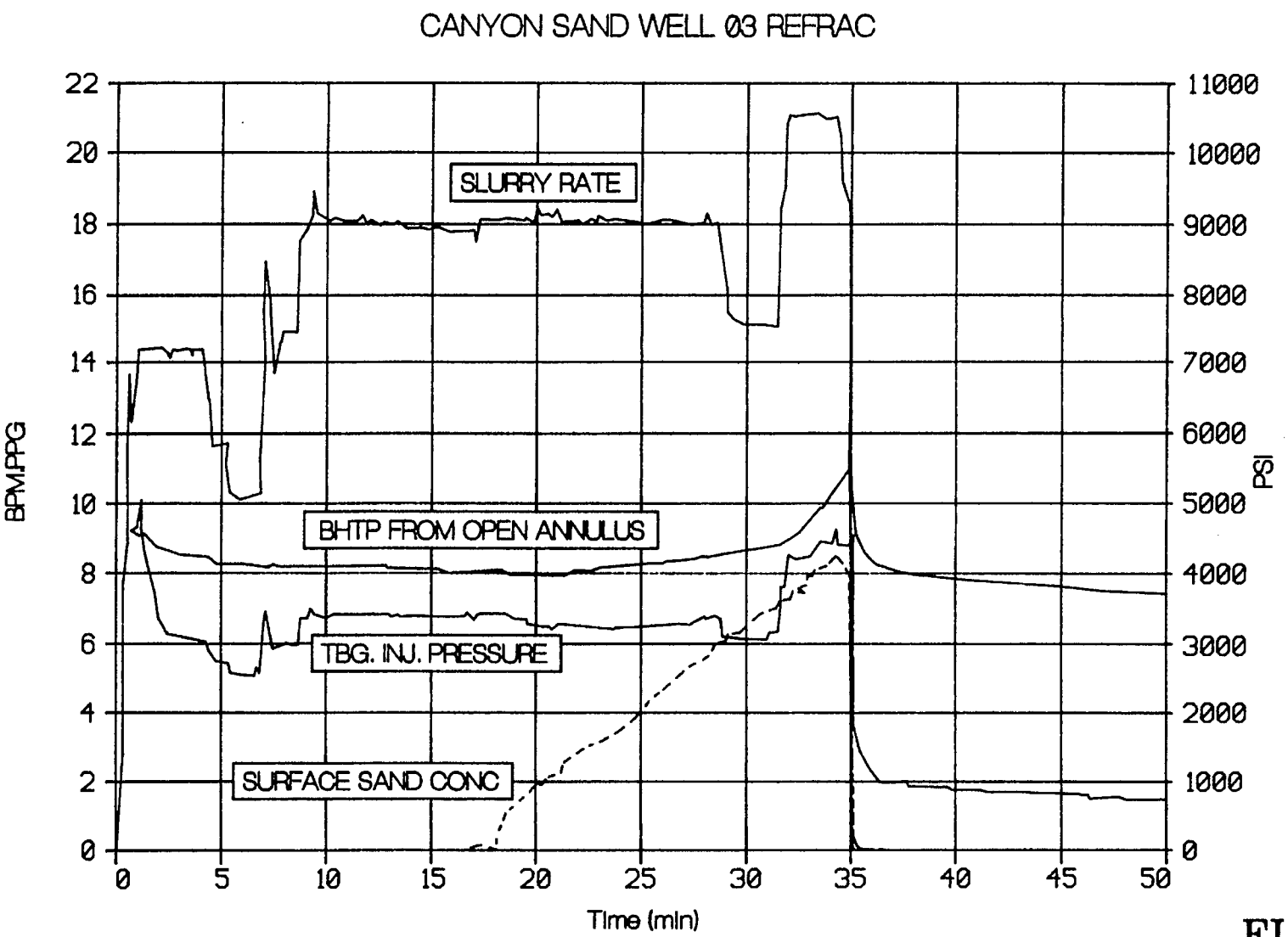
FIG. 6 is a treating record of a refracturing of Canyon Sand Well 03.

FIG. 6 is the treating record of a refrac of Canyon Sand Well 03, one of the wells where we used the open-annulus technique to monitor actual BHTP. The first treatment had almost screened out, and the well was not performing as we expected. It had been perforated with 96 holes at 4 SPF over approximately 22 net ft of pay. The fluid for the refrac was a 30 ppmg borate crosslinked system. Wellbore transit time was about 1.7 min at 18 BPM, and perforation friction should have been negligible.

This well was more difficult to break down than most in this field, probably because it had almost screened out on the previous job, but the BHTP decreased steadily after breakdown. During the pad we made a series of rate changes to check for tortuosity. Starting at 4 min, we dropped from 14 BPM to 10 BPM, then increased to 15 BPM, and finally to the design rate of 18 BPM.

If there had been a tortuous (frictional) restriction near the wellbore, it should have shown itself with step-wise changes in the BHTP. Significantly, the BHTP showed virtually no change over the full range of treating rates. Nonetheless, this well screened out in similar fashion to all the others in this field. There was a gradual increase in BHTP soon after proppant reached the perforations. BHTP increased more quickly as higher-concentration slurry was added until the treatment finally screened out. This treatment placed about 39,000 lb in zone and used 21,500 gal fluid. Overall prop concentration was 1.8 ppg.

Before reaching our pressure limit, we made two rate changes that turned out to be extremely diagnostic. It has been widely discussed during the past few years how rate changes made early in a treatment can diagnose the severity of a tortuous connection between the wellbore and the fracture. However, to my knowledge, this is the first published example where rate changes were used for diagnostic purposes while a treatment was obviously screening out. The data set from this well was extremely useful, and it highlights the value of taking real measurements of BHTP. It also demonstrates the exceptional diagnostic value of techniques which alter the inputs to a dynamic system, because it shows how we were able to characterize that system better by analyzing its response.

Note the two rate changes starting at about 28 minutes. Neither produced the step-wise change in BHTP that would be expected from a restriction near the well (tortuosity). The only reactions were a slight reduction in the rate of pressure increase when we slowed the pump rate, and an even quicker increase in the pressure while we increased the pump rate. This is what a tip screenout should look like, except that the other pressure characteristics show that it occurred close to the well.

Furthermore, it seems one of the other possible explanations for the quickly-rising pressure, that a near-wellbore, immobile proppant bank formed between the well and a single fracture, also is not entirely consistent with this observation. As long as a proppant bank still has open space so fluid can pass, it should act similarly to tortuosity, that is, as a flow restriction. The remaining possibility, that the perforations were nearly covered with sand because of inadequate viscosity, also is not consistent with the data for the same reasons. Although their exact functional relationships vary, all restrictions produce frictional pressure changes in response to rate changes.

If tortuosity, an immobile proppant bank, or covered perfs are not the causes of this type of screenout, then what is? When this data set is analyzed in the context of the recent studies that have either shown[10] or deduced[2-5] the existence of multiple fracture strands, it seems likely the answer is multiple fracture strands. This treating record, which is similar to many other wells, seems to eliminate tortuosity and other near-well restrictions as the cause of the proppant-induced pressure increase that eventually leads to a low-concentration screenout.

The other pressure anomaly, the quickness of the pressure fall-off after shut down, can be attributed to (1) the large amount of fracture surface area that is exposed by multiple narrow fracture strands relative to the fluid volume, and (2) the proximity of the leak-off area to the wellbore. This allows the pressure to decline much more quickly than it would from a wider single fracture, and certainly more quickly than from a single fracture that had partially grown into impermeable bounding beds. The differences between the record from Canyon Sand Well 03 and the ideal-geometry examples shown previously in FIGS. 2 and 3 are the differences between multi-stranded fracturing behavior and ideal geometry behavior.

However, we collected the data set from Canyon Sand Well 03 in early 1993, before there had been widespread discussion that multiple fractures might be a significant complication of frac jobs, and we didn't immediately recognize the significance of the data. In late 1993, we still thought that a tortuous connection from the wellbore to a single, planar fracture was the problem, based upon numerous studies such as Cleary et al[2] and Deimbacher et al[17]. Since another technique[2] for using proppant slugs to solve tortuosity problems had already been documented, we thought it was the most likely solution to our screenout problems.

Figure 7:
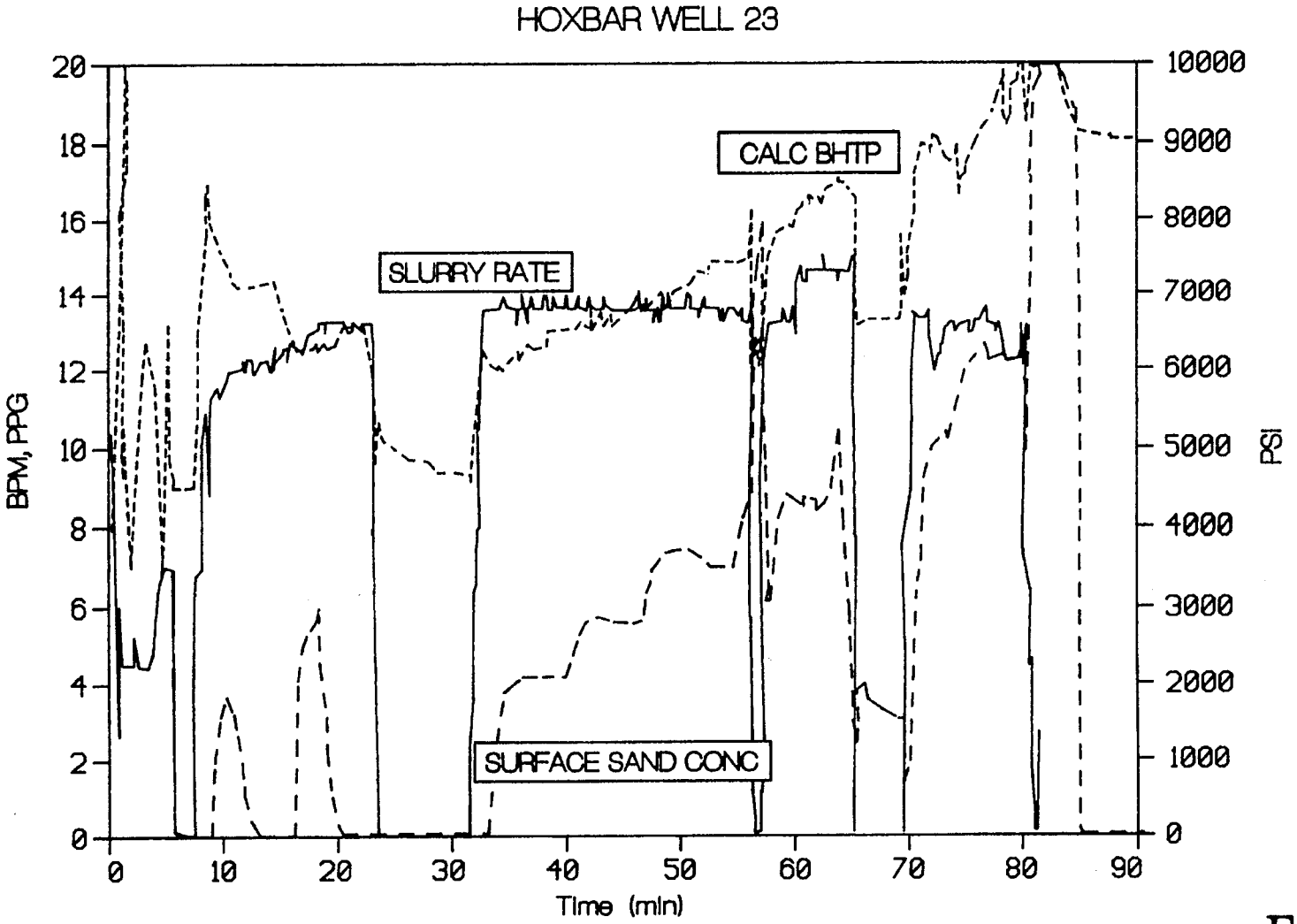
FIG. 7 is a treating record of the Hoxbar Well 23.

Proppant Slugs With High Perforation Density:

FIG. 7 is the treating record of Hoxbar Well 23, the first well we treated using proppant slugs. This is a 10,000 ft well in southwest Oklahoma that was perforated over 14 ft of 0.9 md pay with a total of 58 holes. The well was actually perforated once with 2 SPF and broken down, then reperforated identically and retreated. Before the fracture stimulation, the well produced about 4 BO and 75 MCFD.

The treating record, where BHTP is calculated from surface pressure, shows that the pressure increased at least 1500 psi (between the shutdowns at 23 and 65 min), and probably more by the time the job screened out at 12 ppg. Some of the pressure increase can be explained by the large amount of stress contrast between this partially depleted deep reservoir and the surrounding zones. However, it appears that the large increase in BHTP that occurred between 65 minutes and the final shutdown was caused by at least three near-wellbore screenouts and new fracture initiations. Notice there are at least three pressure breaks, and each was followed by rapidly-increasing pressure. This is exactly what should happen if a new fracture initiates in a moderate-permeability reservoir and there is nothing but concentrated slurry available to fill it. This well also had the characteristic rapid pressure fall-off after shutdown.

Compared to other jobs that have significant pressure growth and eventually screenout, Hoxbar Well 23 is not particularly unusual. However, its performance after the treatment is. Immediately after stimulation, Well 23 improved marginally to about 7 BO and 150 MCFD—approximately double its previous rate. Then, about 45 days later, it increased nearly instantaneously to about 1.5 MMCFD at 800 psi FTP. The change was not gradual, it occurred literally between the time the well was checked one morning, and that same afternoon.

It is difficult to imagine an explanation for this behavior other than some kind of serious obstruction near the well, which was probably frac sand cemented by polymer, and which was eventually dislodged by adequate reservoir pressure. This is an example of what can happen to a well if injection is continued past reasonable limits. This type of screenout is not an effective near-wellbore pack. In fact, it may be closer to a squeeze job. In spite of the problems we had with Hoxbar Well 23, we learned a valuable lesson about near-wellbore screenouts and improved our overall understanding of multi-stranded fracturing behavior.

Canyon Sand Well 11 is the first Canyon well we treated using proppant slugs. (It was treated after Hoxbar Well 23, but before that well cleaned itself up.) We had collected an unusual amount of data on this well, including a longspaced sonic log for mechanical properties and stresses, a full-core analysis, and wireline-tester pressures of individual pay stringers. In addition, we used a 3D fracture model[13] to both design the pump schedule and analyze the treatment in real-time. The annulus was open so we could measure the actual BHTP.

This well had been perforated 4 SPF, 90° phased, with deep-penetrating charges. We had shot 128 holes over 32 net ft of pay (66 ft gross) using multiple gun runs. We anticipated some of the holes would be aligned close to the preferred direction of the fracture and hoped that this would reduce tortuosity. At the time, we thought those perforations that were not ideally aligned would not affect the completion. As a further precaution, we had circulated 30 ppmg borate crosslinked fluid to the end of the tubing, so we could initiate the fracture(s) with a visco-elastic fluid. Others have reported this can reduce excessive treating pressure during a treatment[5]. The job was designed with a small pre-pad of 40 bbl followed by 3 and 5 ppg slugs slightly larger than the 30 bbl tubing volume. Each slug was flushed to the perfs with crosslinked gel.

Figure 8:
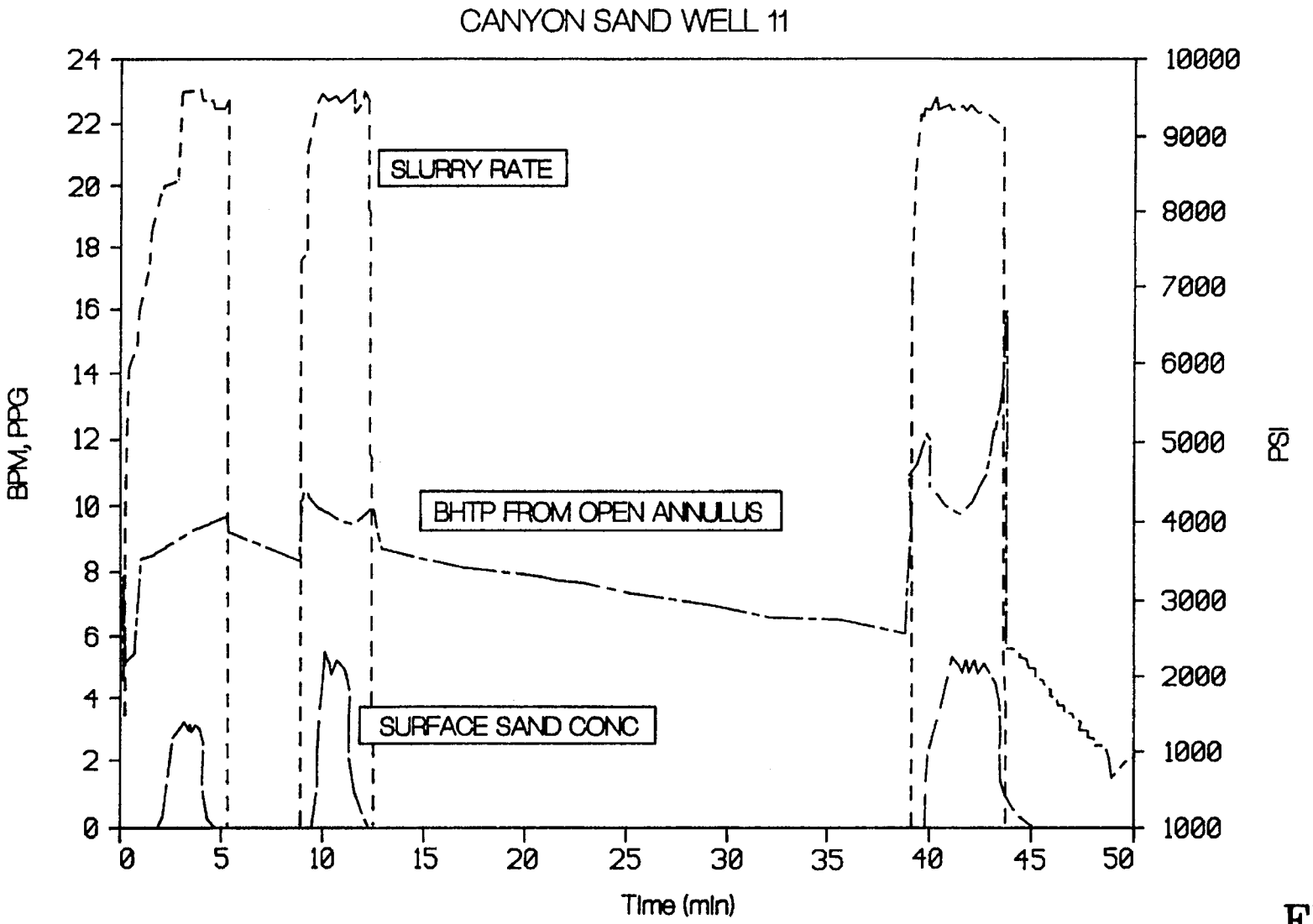
FIG. 8 is a treating record for the Canyon Sand well 11.

This well is a perfect example of the kind of problem that often confronts frac designers. As FIG. 8 shows, we had trouble early in the job pumping the slugs, despite all our precautions. After we broke down the perfs, BHTP seemed normal and increased gradually. However, shortly after the first slug entered the formation, the pressure increase quickened. When we had finished flushing the slug, and shut down, pressure fall-off was initially quick, then moderate. This slug had all the characteristics of a near-wellbore screenout, except on a shorter time scale.

When we resumed pumping and were displacing the clean fluid that was in the tubing, BHTP was higher than it had been at the end of the 3 ppg slug, but quickly broke back as if either the sand were being flushed away, or other fractures or perfs opened up. The 5 ppg slug also looked like a near-wellbore screenout, and the pressure required to eventually restart injection at 38 minutes was even higher. We monitored the 5 ppg shutdown longer than we had intended, because we couldn't match the quickness of the pressure fall-off with our model, unless we severely reduced the in-situ wall-building properties of the frac fluid (recall this was the only significant unknown variable if fracture geometry was ideal). When we resumed pumping, the well screened out with 5 ppg in the perfs, after we had placed about 17,000 lb in zone. (The BHTP after shutdown was not accurate because a defective connection ruptured.) Overall sand/fluid ratio in zone was around 2 ppg.

This sort of situation presents a problem for the frac designer: Why should fluid loss properties, which can be measured reliably at the surface, appear to be so poor at downhole conditions? In our opinion, it is more likely there is some feature of the geometry, like multiple strands, that is nearly impossible to capture generically in the design models. This statement is not an argument against using design models. On the contrary, without a design model to indicate what an ideal situation should look like, the designer will find it extremely difficult to assess the degree of complexity presented by each situation.

By this time, the possibility that densely-shot perforations might cause multiple fractures was being more widely considered. We decided to try to design a completion to minimize that effect as much as possible.

Proppant Slugs with Very-Low Perforation Density:

Shortly after we treated Canyon Sand Well 11, we completed Canyon Sand Well 13. To test the idea that fewer perforations would initiate fewer fracture strands, we shot Well 13 with only 12 big-hole (0.6 in.) shots over about 18 ft of pay in a 58 ft gross interval. The number of holes was chosen solely to limit perforation friction to a moderate level. The phasing was intended to be zero-degree, but was actually 120° because of an error when the guns were loaded.

Even though the previous well had had difficulty accepting slugs, we decided to use them on Well 13 because we thought they could probably be used to screenout secondary fracture strands. To provide a safety factor, we used a heavier gel loading (40 ppmg), and reduced the sand size to 20/40 mesh. We flushed each slug separately and monitored the BHTP during the displacement and during a shutdown following each displacement.

Figure 9:
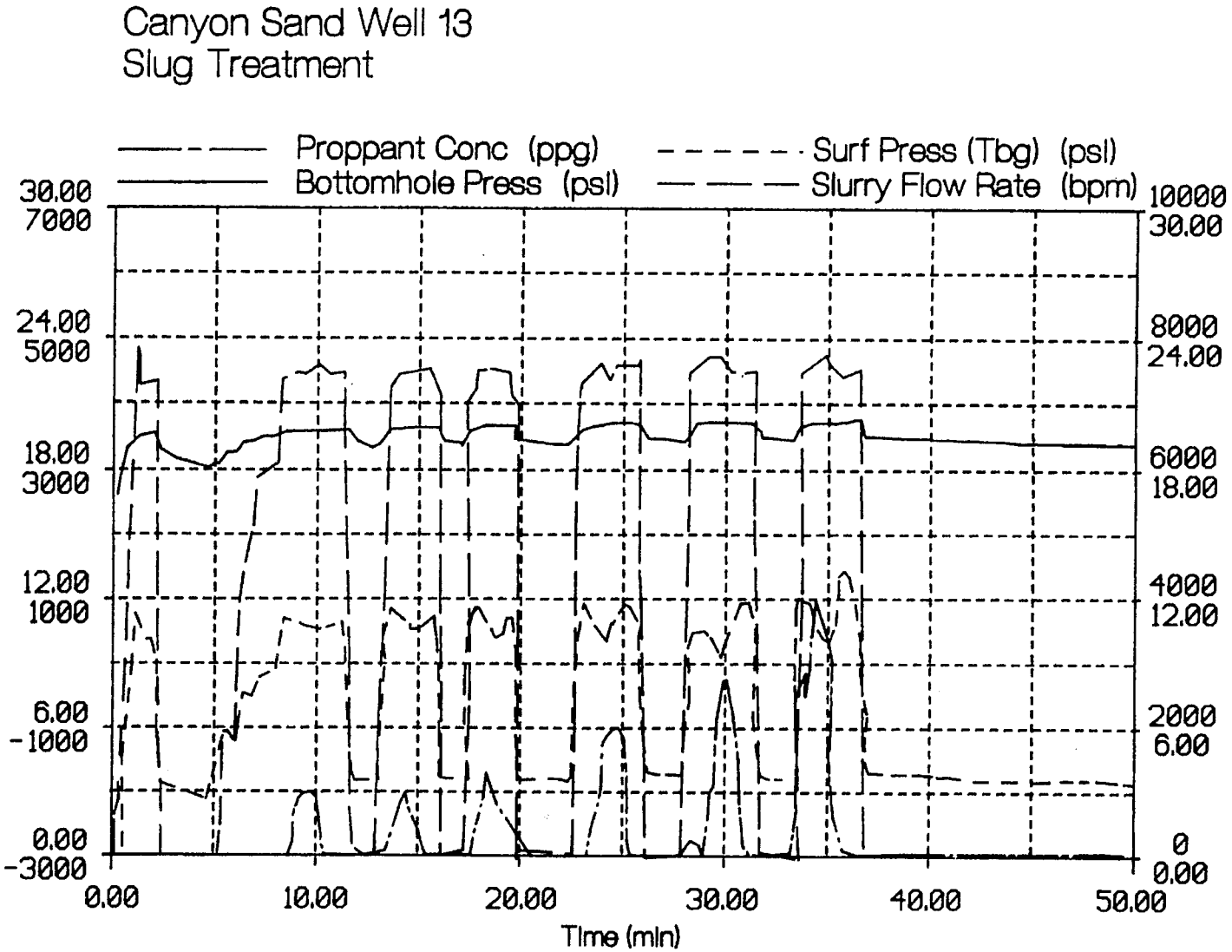
FIG. 9 is a portion of a treating record for the passage of high-concentration, low-volume proppant slugs in accordance with the present invention.

FIG. 9 is the treating record for the portion of the treatment where we pumped the slugs. It shows similar BHTP (measured during the shutdowns) to Well 11, plus approximately 300 psi of perforation friction.

The significant differences between this record and the records from Canyon Sand Wells 03 and 11 are that BHTP (again measured during the shut downs) increases only slightly with time, and there is no evidence of proppantinduced pressure increase near the well. This is true even for the slug that reached nearly 11 ppg. Furthermore, after shut down, there is no unusual and rapid pressure fall-off that quickly moderates. These are much closer to the theoretical characteristics for a single fracture that is extending, and for which pressure loss is dominated by the efficient wall-building properties of the fluid, instead of the permeability of the formation.

This series of slugs was a milestone in our development of the completion design. It diagnosed the degree of fracture complexity. It also gave us confidence that we could develop more fracture width, and therefore pump much higher sand concentrations, through fewer perforations, without screening out. However we used an excessive amount of fluid, requiring 19,000 gal to carry 35,000 lb sand, primarily because we flushed each slug separately.

During the main part of the treatment we successfully placed another 60,000 lb, all at 6, 7, and 8 ppg. This job placed about 2.5 times the previous largest sand volume in the field, and overall sand/fluid ratio was about 50% higher at 3 ppg. However, when fluid loss is as well controlled as it appeared to be, and there is a wide fracture, there is increased risk that much of the sand will be placed below the pay zone if average sand/fluid ratio is not significantly higher. The other result is that money is wasted pumping unnecessary fluid.

Refinements to the Design:

As we became more confident that we could pump higher sand concentrations, we also realized that we might be using more fluid than was necessary by displacing each slug separately. We designed and pumped three additional treatments down tubing during the first half of 1994, and reduced the number of slugs to between two and three. We had a dilemma because we liked knowing that we could successfully pump a certain slurry concentration before we tried a higher one. On the other hand, we planned to complete most of our new wells in 1994 by stimulating multiple zones successively on the same day. This required that all the treatments be pumped down casing. If we continued flushing each slug separately, the only way we could increase the overall sand/fluid ratio was by making the slug volumes larger than the flush volumes. On most wells this would have required we pump in excess of 110 bbl slurry which contains almost 30,000 lb sand for a 9 ppg concentration. We judged that the risk of screening out early in a job with this much sand in one slug would be unacceptably high.

The only other option was to keep the high-concentration slurry, but make the slug volumes smaller. As we worked on this idea, we realized that it would be beneficial to maintain clean fluid spacers between the slugs to lessen the chance of an early screenout. If the fractures cannot accept the concentration or amount of sand in one of the slugs, the clean fluid is available to initiate another fracture and possibly avert a screenout.

Eventually we settled on slug and spacer volumes such that they could all be "loaded" in the casing before the first slug reached the peffs. This schedule is obviously inflexible because there can be no adjustments after all the slugs and spacers are in the pipe. However, there is an important offsetting advantage because total hydrostatic pressure will be constant until the first slug is displaced through the perfs. This makes it easier to interpret changes in surface treating pressure when the slugs are entering the formation.

In accordance with the present invention, we start most treatments now with a small pre-pad of crosslinked gel, usually only 12 to 24 bbl (500 to 1000 gal). We follow this with three or four 10 bbl slugs, usually starting at 5 or 6 ppg and ending at 10 to 13 ppg. These slugs carry about 10- to 12,000 lb sand in total. The last slug is mixed at least as high as the final concentration we intend to pump. This is very useful because it will quickly assess the feasibility of getting a particular slurry concentration through any restriction that might remain near the well. In between the slugs we place the spacer stages, which are identical in volume to the slugs at 10 bbl each but which do not include proppant.

While we are mixing the slugs we generally pump at a reduced rate of 5 to 10 BPM so the blender operator has enough time to build each desired slug concentration and so we can get a reasonably distinct transition between the slugs and the clean fluid. After we mix the last slug we increase the rate to whatever the design requires. When we use four slugs with spacers, they will total about 70 bbl, so we usually have about 2 minutes (at 20 BPM) to get all the equipment operating smoothly before the first slug reaches the perfs.

We overdisplace all the slugs and then shut down to observe the character of the pressure fall-off and compare it to a model[13] prediction for an ideal-geometry stimulation. We do not attempt to change the model input parameters to obtain a match of the pressure history because the actual fracture geometry is likely to be a hybrid of the ideal geometry and some unknown number of fracture strands. The overdisplacement volume reduces the chance that the dominant fracture will close during the shutdown.

In general, we observe a pressure fall-off that declines smoothly from the initial shut-down pressure. It is somewhat quicker than a model prediction, but not nearly as quick as those cases where a near-wellbore screenout has occurred. We don't expect to see the extremely slow decline like the modeled case because there are likely to be some secondary fractures that were screened out and propped and which provide additional leak-off area. If the pressure were to initially fall rapidly, then break to a moderate decline, that would be a clue that all the fractures had screened out and that a dominant fracture was no longer open.

For a treatment down casing, the flush volume will generally suffice for a pad that constitutes 20% of the clean fluid volume after the slugs. For a hypothetical case where the casing volume is approximately 120 bbl, total clean fluid during the main job would be 600 bbl (25,000 gal). If prop concentration averages about 10 ppg for the rest of the job, total prop will be about 200,000 lb and overall sand/fluid ratio will be 8 pounds per gallon. If the prepad, slugs, and spacers are included in the calculations, they will reduce the ratio to about 7.5.

On all the recent treatments we have started the main portion of the job at 9 ppg and attempted to reach 12 or 13 ppg. We routinely include short shutdowns in our treatment schedules even when we use a dead string so that we can periodically monitor the fluid loss that is occurring as the treatment progresses. If pressure falloff accelerates during a treatment, it means that leakoff has increased. This can be a sign that additional fracture strands have opened, particularly if there has also been a significant increase in the rate of increase of treating pressure. If we observe this behavior, we usually terminate a job so we don't squeeze polymer and fluid into the near-wellbore area.

Figure 10:
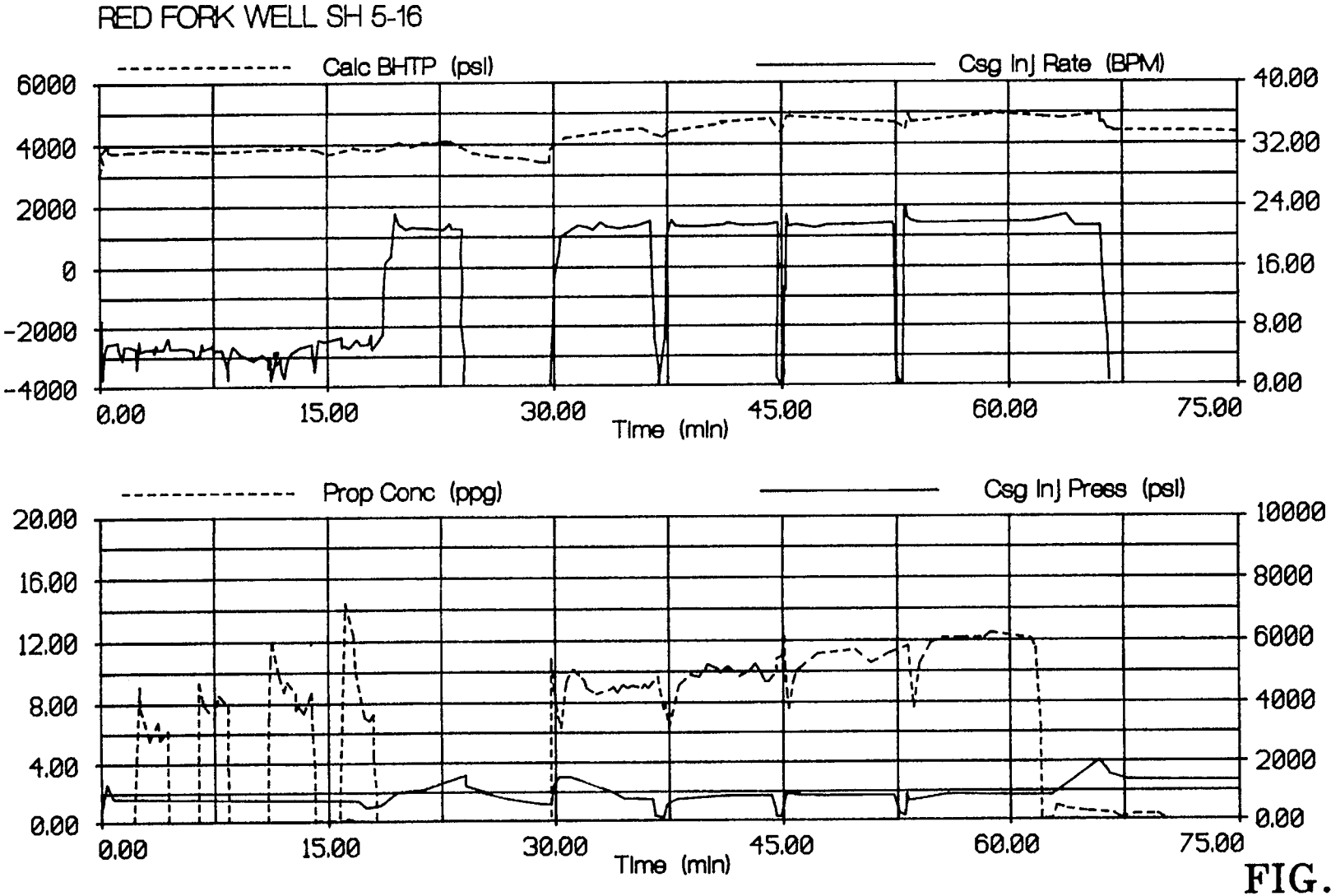
FIG. 10 is a treating record of a controlled screenout completion, in accordance with the present invention.

An Example of a Controlled-Screenout Completion:

One of the first wells we treated using these techniques was Well SH 5–16, a Red Fork gas well. It was perforated zero-degree-phased with 0.59 in. holes at 1 SPF over 20 ft of pay. The well was not broken down prior to the fracture stimulation and the 4.5 in. casing was full (105 bbl) of water. The treatment was pumped at 20 BPM using a 25 ppmg borate-crosslinked system. We used a 500 gal pre-pad plus 2,400 gal fluid to carry and place about 10,900 lb of sand slugs mixed at 6, 8, 10, and 12 ppg. The main portion of the treatment had a 21% pad (the displacement volume for the slugs compared with the total clean fluid after the slugs) and used another 18,000 gal fluid to place 190,000 lb sand. (If the substantial amount of sand is included in the volume calculation, the treatment used only a 15% pad.) The slurry concentration ranged from 9 to 12 ppg and averaged 10.6 ppg. Overall sand/fluid ratio for the complete job was 7.8 ppg. FIG. 10 is the treating record for the well.

Early in the job, we pumped at only 5 BPM to give the blender operator time to mix the sand slugs and switch to the clean fluid spacers. (Note that this makes the slug stages appear to be larger than they actually were.) When all the slugs had been mixed, we increased to the design rate of 20 BPM, and displaced them into the formation. The first shut-down, which lasted from about 24 min to 30 min, had a relatively rapid pressure fall-off because this was a higher-perm, lower-pressure well, but it had none of the characteristics of a near-wellbore screenout. We started immediately with 9 ppg slurry and pumped equal volumes of clean fluid mixed with 9, 10, 11, and 12 ppg of 20/40 sand. Just before we switched from each slurry concentration to the next, we shut down for approximately 1 min to measure the true BHTP and observe the character of the pressure fall-off. The treating record shows that the BHTP increased gradually and normally during the job. The other important characteristic is that the final pressure fall-off was much slower than the fall-off after the slugs had been placed. This shows that the leak-off was closer to an ideal-case fracture stimulation for this formation.

Table 1 provides information about the 13 completions where we have developed and applied the basic techniques previously discussed. Ten of these treatments placed significantly higher sand concentrations than is normally placed in these areas, and three wells screened out while we were pumping slugs. One of the three, Hill Well 43, was a rework of a completion that had already been shot 4 SPF, and was in a field where we had no fracturing experience. The second was a well in a dolomite reservoir that we had shot with extremely large charges (90 gm), acidized, and kept seeing nearwellbore screenouts as we continued pumping slugs. We believe the perforating and acidizing combined to produce many wide and complex fractures that were difficult to screenout in a controlled fashion. The third well, Red Fork Well W B 1–11, screened out for reasons which we have not been able to explain.

TABLE 1

CONTROLLED-SCREENOUT COMPLETIONS

| WELL NAME | FRAC DATE | GROSS ZONE (FT) | PERF HOLES | PERF PHASE (DEG) | PERF EHD (IN) | FLUID TYPE | GEL LOAD (PPMG | PRE-PAD (GAL) | SLUG CONC'S (PPG) |
|---|---|---|---|---|---|---|---|---|---|
| Canyon 13 | Jan-94 | 52 | 12 | 120 | 0.60 | X LINK | 30 | 2,520 | 3-10 |
| Red Fork C 3-9 | Jan-94 | 13 | 14 | 0 | 0.62 | FOAM | 40 | 4,200 | 3-9 |
| Red Fork A 1R-28 | Jan-94 | 24 | 11 | 0 | 0.62 | FOAM | 30 | 8,640 | 4-12 |
| Hoxbar 1416 | May-94 | 128 | 86 | 180 | NA | X LINK | 25 | 1,327 | 4-6 |
| Hoxbar 0702 | Jun-94 | 137 | 155 | 180 | NA | X LINK | 25 | 811 | 7-7 |
| Hill 43 | Jul-94 | 14 | 56 | 90 | NA | X LINK | 25 | 1,202 | 3-7 |
| Red Fork E 5-35 | Jul-94 | 20 | 21 | 0 | 0.60 | X LINK | 25 | 311 | 6-12 |
| Red Fork SH 5-16 | Jul-94 | 20 | 21 | 0 | 0.59 | X LINK | 25 | 504 | 6-12 |
| Blinebry 15 | Sep-94 | 32 | 33 | 0 | 0.67 | X LINK | 30 | 600 | 2-6 |
| Red Fork N 5-19 | Sep-94 | 41 | 14 | 0 | 0.53 | FOAM | 40 | 500 | 2-12 |
| Red Fork MK 1-11 | Oct-94 | 8 | 9 | 0 | 0.80 | X LINK | 25 | 462 | 6-12 |
| Red Fork W B 1-11 | Oct-94 | 6 | 7 | 0 | 0.53 | X LINK | 25 | 420 | 4-9 |
| Red Fork N B 1-6 | Oct-94 | 10 | 11 | 0 | 0.55 | X LINK | 25 | 1,006 | 6-12 |

TABLE 1-continued

CONTROLLED-SCREENOUT COMPLETIONS

| WELL NAME | SLUG PROP (LB) | PAD VOL (GAL) | PAD FRAC (%) | MAIN CONC'S (PPG) | MAIN PROP (LB) | MAIN AVG (PPG) | TOTAL FLUID (GAL) | TOTAL PROP (LB) | OVERALL PROP/ FLUID (PPG) |
|---|---|---|---|---|---|---|---|---|---|
| Canyon 13 | 36,900 | 4,790 | 37 | 6-8 | 59,100 | 7.1 | 26,670 | 96,000 | 3.3 |
| Red Fork C 3-9 | 24,000 | 3,738 | 20 | 6-9 | 96,000 | 6.6 | 34,104 | 120,000 | 3.5 |
| Red Fork A 1R-28 | 71,000 | 3,856 | 31 | 8-12 | 75,000 | 8.7 | 39,136 | 146,000 | 3.7 |
| Hoxbar 1416 | 20,200 | 3,717 | 20 | 7-9 | 115,800 | 7.8 | 26,497 | 136,000 | 4.6 |
| Hoxbar 0702 | 5,600 | 3,074 | 14 | 7-9 | 138,600 | 7.2 | 25,192 | 144,200 | 5.7 |
| Hill 43 | 3,700 | | | | | | 2,902 | 3,700 | 1.3 |
| Red Fork E 5-35 | 10,400 | 4,229 | 19 | 9-12 | 161,600 | 8.9 | 25,267 | 172,000 | 6.8 |
| Red Fork SH 5-16 | 10,900 | 4,700 | 21 | 9-12 | 190,200 | 10.5 | 25,754 | 201,100 | 7.8 |
| Blinebry 15 | 35,300 | | | | | | 35,600 | 35,300 | 1.0 |
| Red Fork N 5-19 | 13,500 | 4,500 | 26 | 10-13 | 141,500 | 10.9 | 19,090 | 155,000 | 8.1 |
| Red Fork MK 1-11 | 10,700 | 1,890 | 16 | 9-10 | 93,900 | 9.5 | 14,672 | 104,600 | 7.1 |
| Red Fork W B 1-11 | 3,400 | | | | | | 1,690 | 3,400 | 2.0 |
| Red Fork N B 1-6 | 10,700 | 5,000 | 23 | 9-13 | 163,700 | 9.7 | 25,394 | 174,400 | 6.9 |

Discussion:

Behrmann and Elbel[10] showed that it is common for individual perforations to initiate individual fractures. They also showed that dominant fractures often initiate from t.he annulus at the cement/rock interface in the preferred fracturing plane when the perforations are not close to that plane. This shows that the most likely path from zero-degree-phased perforations to a primary fracture is through the annulus.

If we consider an ideal situation where only a single planar (double-winged) fracture forms, it is easy to see why zero-degree-phased perforating has generally been thought to be unwise. If the annulus is axially symmetric with respect to the casing, the annular width should be about ½ the fracture width, and therefore might restrict flow and provide a bridging site for the proppant.

However, our experience indicates that any improvement in fracture access attributable to high perforation density is outweighed by the detrimental effects of having numerous narrow fractures that initiate from those perforations. Even though the complex interactions between numerous fracture strands and the borehole wall have not been studied extensively and therefore are not entirely understood, our experience indicates it is possible to design completidns that can control excessive loss of the pad and slurry to multiple fractures.

Desion Considerations:

Regardless of which generic type of fracture geometry is expected—a radial fracture for a thick, poorly-bounded zone, or multiple fractures for a thin zone that is well-bounded—it will generally be necessary to perforate with at least 10 shots to keep perforation friction manageable. This means that there will be at least that many sites for fractures to initiate. If at least 10 fractures are possible in most completions, it should be beneficial to use proppant slugs almost routinely.

When proppant slugs are used, it is necessary to decide how high the slurry concentration should be and how much sand to use. We have used a maximum of 12 ppg primarily because that was close to the maximum concentration we intended to pump during the main part of the job. There has only been one case where we had difficulty pumping a 12 ppg slug after lower-concentration slugs, and that appeared to be because we were using a temperature-activated-crosslink fluid, and didn't have crosslinked gel at the perforations. Presently we don't have a way to determine the maximum concentration that should be pumped except by trial and error. However, it is interesting to note that we have pumped one series of slugs where we had no excessive treating pressure even when the last slug inadvertently reached nearly 20 ppg.

A volumetric example may offer some guidance on the question of how much sand should be pumped. Our designs normally use slugs that total approximately 11,000 lb sand, which has a bulk volume of 110 $ft^3$. If we postulate that we have fracture strands that are 50 ft high, and which are 0.5 in. wide in total, that volume of sand is sufficient to fill double-winged fractures to a distance of 26 ft. This seems more reasonable than if the penetration had calculated to perhaps 3 or 4 ft.

The uncertainty about how the resistance of the borehole wall changes as the job progresses raises some interesting questions about how slurry concentration should be varied throughout the treatment. In particular, it seems reasonable that high slurry concentrations should provide a means to quickly screenout secondary fractures that may try to open when wellbore pressure rises as a result of fracture extension. Therefore, if secondary fractures have been controlled by sand slugs early in the job, pumping high-concentration slurry early in the main treatment may increase the chance of placing more sand by continually screening out secondary fractures shortly after they open at the borehole wall. Conversely, if the proppant slugs are not followed with high slurry concentration, there may be an increased risk of screenouts if secondary fractures form.

We have pumped only one treatment in a carbonate reservoir. Although our experience is limited, it indicates that extensive acidizing of carbonates prior to a sand frac may create fracture strands with more complexity and width than would typically be present in a sandstone. This may make it more difficult to intentionally screenout secondary fractures during a sand frac. This effect should be considered when a breakdown treatment volume is being chosen for a carbonate reservoir.

Finally, breaker scheduling should be re-evaluated for the slug stages because this sand will be lodged in the area around the wellbore and may have some of the most highly-concentrated polymer. On standard designs, the lightest breaker loading is generally during the earliest part of the treatment because of the expectation that the first fluid will be at the tip of the fracture and therefore needs to maintain adequate viscosity for the longest time. We have modified our schedule to use a high breaker concentration with the slugs and a normal breaker schedule afterward.

Two operational items are essential to the successful execution of these treatments. First, the blender operator must be sufficiently skillful to mix unusually-small volumes of slurry, and to quickly switch between clean fluid and slurry. A small blender tub facilitates these operations, but larger tubs can be modified to perform adequately. Second, the fluid must be well-crosslinked before it reaches the perforations so there is adequate viscosity to transport sand to the fracture. Finally, and although it may not be absolutely necessary, we prefer to have a surface crosslink of the fluid so that the slurry won't become more concentrated from settlement that might occur during the shutdowns.

Table 1 is a record of thirteen experimental completion operations which were utilized to develop the fracturing method of the present invention, and which include the dead ends discovered through the experimentation. Several trends within this compilation of data are noteworthy. First, note that the overall proppant to fluid ratio (in units of pounds per gallon of fluid) increased generally from about three pounds per gallon to seven to eight pounds per gallon. Second, note that the overall weight of the proppant material delivered to the formation increased considerably, while the total fluid utilized remained substantially constant. Third, note that the concentration of the slugs of the preliminary controlled screenout fracturing operation generally increased and the total weight (sand plus fluid) decreased. Fourth, note that the perforation density decreased generally.

Table 2 sets forth an example or model of a controlled-screenout stimulation in accordance with the present invention. This exemplary treatment scheduled is contemplated for pay zones having a thickness of ten to twenty feet. Preferably a cross-linked gel fluid system is utilized to carry 20/40 mesh proppant material such as sand. The typical injection rate would be fifteen to twenty-five barrels per minute, depending upon whether the treatment is pumped down tubing or casing. This schedule is appropriate for a case where conventional fracture stimulations have difficulty exceeding eight pounds per gallon of slurry. It uses four proppant slugs of increasingly-concentrated slurry to progressively screenout narrow fracture strands, and divert flow into a smaller number of wider fractures. A six pound per gallon slurry concentration is chosen for the first slug, because eight pounds per gallon slurry is known to cause screenouts for conventionally-completed wells. For this particular example, the volume of the tubulars between the surface and the pay zone is presumed to be 4,200 gallons. The proppant volumes total 10,600 lb in the slugs and 189,000 lb in the main job.

| STAGE | CLEAN VOL (gas) | PROP CONC. (ppg) | SLURRY VOL (gal) | COMMENTS |
|---|---|---|---|---|
| 1 | 1000 | 0 | 1000 | Pre-pad |
| 2 | 330 | 6 | 420 | Slug #1 |
| 3 | 420 | 0 | 420 | Spacer 1 |
| 4 | 310 | 9 | 420 | Slug #2 |
| 5 | 420 | 0 | 420 | Spacer #2 |
| 6 | 290 | 10 | 420 | Slug #3 |
| 7 | 420 | 0 | 420 | Spacer #3 |
| 8 | 270 | 12 | 420 | Slug #4 |
| 9 | 5000 | 0 | 1000 | Overflush slugs - Main job pad |
| 10 | | | | Shut down, observe pressure |
| 11 | 4500 | 9 | 6330 | Start main job |
| 12 | 4500 | 10 | 6530 | |
| 13 | 4500 | 11 | 6740 | |

-continued

| STAGE | CLEAN VOL (gas) | PROP CONC. (ppg) | SLURRY VOL (gal) | COMMENTS |
|---|---|---|---|---|
| 14 | 4500 | 12 | 6940 | |
| 15 | 4200 | 0 | 4200 | Displace to top perf |

Conclusions:

The following items represent conclusions which have been reached:

1. Excessive treating pressure that occurs when low-concentration slurry first enters the formation (proppant-induced pressure increase[1]) appears to be caused by proppant bridging in multiple narrow fracture strands that originate from the performions and/or the borehole wall.
2. Low-concentration screenouts are caused by proppant bridging near the wellbore in these multiple narrow fractures.
3. An effective completion design strategy to control these effects is to (a) limit the number of perforations to the minimum necessary to obtain reasonable perforation friction loss, (this should be determined on a case-by-case basis and is influenced by (1) the type of fracturing fluid utilized, (2) the required pump rate of the fracturing schedule, and (3) the total cross-sectional area of the perforations) and (b) pump high-concentration proppant slugs and spacers early in the treatment to screenout secondary fractures.
4. Various alternatives to perforating could be utilized to further minimize the number of fracture initiation sites to perhaps obtain further improved fracturing, such as, for example, the utilization of an abrasive jetting device used for notching casing, or by utilization of various commercially available alternatives means for creating flow paths through casing.
5. It is very important to recognize multi-stranded fracturing behavior, otherwise aggressive treatments may reduce well productivity.
6. The borehole wall and the fractures that initiate from it need to be studied more extensively as a fully-coupled system.

While the invention has been shown in only one of its forms, it is not thus limited but is susceptible to various changes and modifications without departing from the spirit thereof.

The references discussed in this application are set forth below:

1. Barree, R. D.: "A New Look At Fracture-Tip Screenout Behavior," paper SPE 18955 presented at the 1989 SPE Rocky Mountain Regional Meeting/Low-Permeability Reservoirs Symposium, Denver, Mar. 6–8
2. Cleary, M. P., Johnson, D. E., Kogsbell, H-H., Owens, K. A., Perry, K. F., de Pater, C. J., Stachel, A., Schmidt, H., and Tambini, M.: "Field Implementation of Proppant Slugs to Avoid Premature Screenout of Hydraulic Fractures With Adequate Proppant Concentration," paper SPE 25892 presented at the 1993 Rocky Mountain Regional Meeting/Low Permeability Reservoirs Symposium, Denver, Apr. 26–28
3. Cleary, M. P., Wright, C. A., and Wright, T. B.: "Experimental and Modeling Evidence for Major Changes in Hydraulic Fracturing Design and Field Practices," paper SPE 21494 presented at the 1991 SPE Gas Technology Symposium, Houston, Jan. 23–25

4. Cleary, M. P., Doyle, R. S., Teng, E. Y., Cipolla, C. L., Meehan, D. N., Massaras, L. V., and Wright, T. B.: "Major New Developments in Hydraulic Fracturing, with Documented Reductions in Job Costs and Increases in Normalized Production," paper SPE 28565 presented at the 1994 SPE Annual Technical Conference and Exhibition, New Orleans, Sep. 25–28

5. Aud, W. W., Wright, T. B., Cipolla, C. L., Harkrider, J. D., and Hansen, J. T.: "The Effect of Viscosity on Near-Wellbore Tortuosity and Premature Screenouts," paper SPE 28492 presented at the 1994 SPE Annual Technical Conference and Exhibition, New Orleans, Sep. 25–28

Medlin, W. L. and Fitch, J. L.: "Abnormal Treating Pressures in Massive Hydraulic Fracturing Treatments," paper SPE 12108 presented at the 1983 SPE Annual Technical Conference and Exhibition, San Francisco, Oct. 5–8

7. Palmer, I. D. and Veatch, R. W. Jr.: "Abnormally High Fracturing Pressures in Step-Rate Tests," paper SPE 16902 presented at the 1987 SPE Annual Technical Conference and Exhibition, Dallas, Sep. 27–30

8. Nolte, K. G.: "Discussion of Examination of a Cored Hydraulic Fracture in a Deep Gas Well," paper SPE 26302, SPEPF (Aug. 1993) 159

9. Jeffrey, R. G., Vandamme, L., and Roegiers, J.-C.: "Mechanical Interactions in Branched or Subparallel Hydraulic Fractures," paper SPE 16422 presented at the 1987 SPE/DOE Joint Symposium on Low Permeability Reservoirs, Denver, May 18–19

10. Behrmann, L. A. and Elbel, J. L.: "Effect of Perforations on Fracture Initiation," paper SPE 20661 presented at the 1990 SPE Annual Technical Conference and Exhibition, New Orleans, Sep. 23–26

11. Warpinski, N. R., Lorenz, J. R., Branagan, P. T., Myal, F. R., and Gall, B. L.: "Examination of a Cored Hydraulic Fracture in a Deep Gas Well," paper SPE 22876 presented at the 1991 SPE Annual Technical Conference and Exhibition, Dallas, Oct. 6–9

12. Nolte, K. G., and Smith, M. B.: "Interpretation of Fracturing Pressures," JPT, (Sep. 1981) 1767

13. Crockett, A. R., Okusu, N. M., and Cleary, M. P.: "A Complete Integrated Model for the Design and Real-Time Analysis of Hydraulic Fracturing Operations," paper SPE 15069 presented at the 1986 SPE California Regional Meeting, Oakland, Apr. 2–4

14. Settari, A., and Cleary, M. P.: "Three-Dimensional Simulation of Hydraulic Fracturing," paper SPE 10504 presented at the 6th SPE Reservoir Simulation Symposium, New Orleans, Feb. 1982

15. Barree, R. D.: "A Practical Numerical Simulator for Three-Dimensional Hydraulic Fracture Propagation in Heterogeneous Media," paper SPE 12273 presented at the 1983 Symposium on Reservoir Simulation, San Francisco, Nov. 15–18

16. Cipolla, C. L., Meehan, D. N., and Stevens, P. L.: "Hydraulic Fracture Performance in the Moxa Arch Frontier Formation," paper SPE 25918 presented at the 1993 Rocky Mountain Regional Meeting/Low Permeability Reservoirs Symposium, Denver, Apr. 26–28

17. Deimbacher, F. X., Economides, M. J., and Jensen, O. K.: "Generalized Performance of Hydraulic Fractures With Complex Geometry Intersecting Horizontal Wells," paper SPE 25505 presented at the 1993 Rocky Mountain Regional Meeting/Low Permeability Reservoirs Symposium, Denver, Apr. 26–28

What is claimed is:

1. A method of fracturing a wellbore to facilitate production of hydrocarbons from a surrounding formation, comprising the method steps of:

performing a preliminary controlled screenout fracturing operation by directing a plurality of relatively low-volume, high-concentration proppant slugs into said formation to screenout narrow fractures; and performing a secondary conventional fracturing operation by directing fracturing fluids into said formation in order to create and enlarge a relatively small number of remaining wider fractures.

2. A method of fracturing a wellbore according to claim 1, further including:

interspersing a plurality of clean spacer stages with said plurality of relatively low-volume, high-concentration proppant slugs during said step of performing a preliminary controlled screenout fracturing operation.

3. A method of fracturing a wellbore according to claim 1, wherein said step of performing a preliminary controlled screenout fracturing operation comprises:

performing a preliminary controlled screenout fracturing operation by directing a plurality of proppant slugs composed of fluid and proppant particles in a concentration of proppant mass per unit fluid which is greater than that normally employed for fracturing operations for similar wellbores.

4. A method of completing a wellbore to facilitate production of hydrocarbons from a surrounding formation, comprising the method steps of:

perforating a casing in said wellbore in a region of anticipated hydrocarbon production and thereby likely facilitating the creation of an unknown number of relatively wide fractures and an unknown number of relatively narrow fractures;

performing a preliminary controlled screenout fracturing operation by directing a plurality of relatively low-volume, high-concentration proppant slugs into said formation to screenout said unknown number of relatively narrow fractures; and performing a secondary conventional fracturing operation by directing fracturing fluids into said formation in order to enlarge said unknown number of relatively wide fractures.

5. A method of completing a wellbore according to claim 4, wherein said step of perforating comprises:

perforating a casing in said wellbore in a region of anticipated hydrocarbon production with a plurality of perforations having a relatively low number of perforations per unit length of casing, and thereby facilitating the creation of an unknown number of relatively wide fractures and an unknown number of relatively narrow fractures.

6. A method of completing a wellbore according to claim 5, wherein said relatively low number of perforations per unit length of casing comprises at most one perforation per foot of length of casing.

7. A method of completing a wellbore according to claim 4, wherein said step of perforating comprises:

perforating a casing in said wellbore in a region of anticipated hydrocarbon production with a plurality of perforations whose numbers and size is determined by the minimum number of perforations necessary to obtain an acceptable amount of perforation friction loss.

8. A method of completing a wellbore according to claim 4, further including:

interspersing a plurality of clean spacer stages with said plurality of relatively low-volume, high-concentration proppant slugs during said step of performing a preliminary controlled screenout fracturing operation.

9. A method of completing a wellbore according to claim 4, further including:

performing said preliminary controlled screenout fracturing operation by directing a plurality of proppant slugs composed of fluid and proppant particles in a concentration of proppant mass per unit of fluid which is greater than that normally employed for fracturing operations for similar wellbores.

10. A method of completing a wellbore to allow production of hydrocarbons from a surrounding formation, comprising the method steps of:

perforating a casing in said wellbore in a region of anticipated hydrocarbon production in order to create a number of fracture initiation sites;

directing a plurality of relatively low-volume, high-concentration proppant slugs into said formation to screenout an unknown number of relatively narrow fractures of said fracture initiation sites; and directing fracturing fluids into said formation in order to at least enlarge the remaining wide fractures of said fracture initiation sites.

11. A method of completing a wellbore according to claim 10, wherein said step of perforating comprises:

perforating a casing in said wellbore in a region of anticipated hydrocarbon production, to provide a relatively low perforation density, in order to create a number of fracture initiation sites.

12. A method of completing a wellbore according to claim 10, wherein said plurality of low volume, high-concentration proppant slugs comprise:

a plurality of proppant slugs having a proppant concentration in the range of 3–16 pounds per gallon of carrier fluid.

13. A method of completing a wellbore according to claim 10, wherein said plurality of low volume, high-concentration proppant slugs comprise:

a plurality of proppant slugs having a volume in the range of 400–1,000 gallons.

14. A method of completing a wellbore according to claim 10, further comprising:

interspersing a plurality of a clean spacer stages within said plurality of low-volume, high-concentration proppant slugs.

* * * * *